US010167132B2

(12) United States Patent
Sines

(10) Patent No.: US 10,167,132 B2
(45) **Date of Patent: *Jan. 1, 2019**

(54) ELEVATING LIFT DISPENSER AND CONTAINER

(71) Applicant: Twist 'n Serve, LLC, Tucson, AZ (US)

(72) Inventor: Randy D. Sines, Tucson, AZ (US)

(73) Assignee: Twist 'n Serve, LLC, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,999

(22) Filed: Feb. 13, 2018

(65) Prior Publication Data

US 2018/0237210 A1 Aug. 23, 2018

Related U.S. Application Data

(63) Continuation of application No. 13/987,432, filed on Jul. 24, 2013, now Pat. No. 9,896,260, which is a (Continued)

(51) Int. Cl.
*B65D 83/00* (2006.01)
*B65D 81/22* (2006.01)
*B65D 85/36* (2006.01)

(52) U.S. Cl.
CPC ..... *B65D 83/0083* (2013.01); *B65D 81/22* (2013.01); *B65D 83/0005* (2013.01); *B65D 83/0027* (2013.01); *B65D 85/36* (2013.01)

(58) Field of Classification Search
CPC B65D 81/22; B65D 83/0005; B65D 83/0027; B65D 83/0083; B65D 85/36
(Continued)

(56) References Cited

U.S. PATENT DOCUMENTS 1,205,026 A 11/1916 Rodgers
2,904,205 A 9/1959 Callery
(Continued)

FOREIGN PATENT DOCUMENTS

WO 2009/091362 7/2009

OTHER PUBLICATIONS

Emmanuel, European Search Report, dated Jan. 10, 2017, 9 pages, European Patent Office, Munich, Germany.
(Continued)

*Primary Examiner* — Michael Collins
(74) *Attorney, Agent, or Firm* — Ellen M. Bierman; Lowe Graham Jones PLLC

(57) ABSTRACT

A container includes a canister having an upper lip, and an operator having an operator main body. The operator has a gripping ring at one end that defines an operator upper lip and a container opening. The gripping ring outside diameter is greater than an outside diameter of the operator main body. The canister includes a helical grooved canister engagement feature which extends about the canister. The operator includes an operator engagement feature which is a longitudinal slot formed through the operator main body. A lift having a lift projection is received in the operator, and the operator main body is received within the canister, with the lift projection extending through the operator engagement feature and into the canister engagement feature. The gripping ring extends at least partially over the canister upper lip, and a lower edge of the gripping ring is located adjacent the canister upper lip.

20 Claims, 27 Drawing Sheets

Related U.S. Application Data continuation-in-part of application No. 12/072,551, filed on Feb. 26, 2008, now Pat. No. 8,523,013, which is a continuation-in-part of application No. 12/008,905, filed on Jan. 14, 2008, now abandoned, which is a continuation-in-part of application No. 11/076,386, filed on Mar. 9, 2005, now abandoned.

(58) Field of Classification Search
USPC ..... 221/209, 185, 190, 186, 254, 279; 220/669
See application file for complete search history.

(56) References Cited

U.S. PATENT DOCUMENTS

| | | | | |
|---|---|---|---|---|
| 3,040,897 | A | 6/1962 | Holman | |
| 3,380,592 | A | 4/1968 | Arnold | |
| 3,515,493 | A | 6/1970 | Gruska | |
| 3,688,945 | A | 9/1972 | Harman, Jr. et al. | |
| 3,815,787 | A | 6/1974 | Spies | |
| 3,850,183 | A | 11/1974 | Gruska | |
| 4,384,658 | A | 5/1983 | Large | |
| 4,432,451 | A | 2/1984 | Hooser | |
| 5,324,126 | A | 6/1994 | Holloway et al. | |
| 5,337,915 | A | 8/1994 | Hall, Jr. | |
| 5,399,040 | A | 3/1995 | Holloway | |
| 5,538,161 | A | 7/1996 | Koehler et al. | |
| 5,634,569 | A | 6/1997 | DeCoster | |
| 5,842,803 | A | 12/1998 | Furnell | |
| 5,868,266 | A | 2/1999 | Nobakht | |
| 5,883,806 | A | 3/1999 | Meador et al. | |
| 5,908,139 | A | 6/1999 | Pearson | |
| 5,918,535 | A | 7/1999 | Moreau | |
| 6,004,054 | A | 12/1999 | Wei-Pin | |
| 6,036,038 | A | 3/2000 | Lovelace et al. | |
| 6,047,854 | A | 4/2000 | Demers et al. | |
| 6,092,717 | A | 7/2000 | Lowry | |
| 6,116,407 | A | 9/2000 | Zolicoffer et al. | |
| 6,164,471 | A | 12/2000 | Kassouni | |
| 6,745,918 | B2 | 6/2004 | Greene | |
| 7,191,915 | B2 | 3/2007 | Hair, III et al. | |
| 7,487,878 | B2 | 2/2009 | Giwargis et al. | |
| 7,544,294 | B2 * | 6/2009 | Halterman | A47G 19/30 206/804 |
| 7,556,167 | B2 | 7/2009 | Giwargis et al. | |
| 7,767,087 | B2 * | 8/2010 | Wilson | C02F 1/003 210/120 |
| 8,523,013 | B2 * | 9/2013 | Sines | B65D 21/08 221/135 |
| 9,896,260 | B2 * | 2/2018 | Sines | B65D 83/0083 |
| 2004/0148055 | A1 | 7/2004 | Shoenfeld | |
| 2006/0201963 | A1 | 9/2006 | Sines et al. | |
| 2008/0110922 | A1 | 5/2008 | Sines | |
| 2008/0149661 | A1 | 6/2008 | Sines | |
| 2013/0313258 | A1 | 11/2013 | Sines | |

OTHER PUBLICATIONS

International Search Report and Written Opinion of the International Searching Authority dated Oct. 10, 2014, in International Patent Application No. PCT/US14/00167, 7 pages.

* cited by examiner

ELEVATING LIFT DISPENSER AND CONTAINER

CROSS REFERENCE TO RELATED APPLICATIONS

This application claims continuation priority to U.S. patent application Ser. No. 13/987,432, filed Jul. 24, 2013, which is a continuation-in-part of U.S. patent application Ser. No. 12/072,551, filed Feb. 26, 2008, now U.S. Pat. No. 8,523,013, issued Sep. 3, 2013, which is a continuation-in-part of U.S. patent application Ser. No. 12/008,905, filed Jan. 14, 2008 (now abandoned), which is a continuation-in-part of U.S. patent application Ser. No. 11/076,386, filed Mar. 9, 2005 (now abandoned). Priority under 35 U.S.C. § 120 (or as otherwise provided by law) is hereby claimed. Such prior applications are incorporated by reference herein in their entireties. Applicant further reserves the right to withdraw one or more of these priority claims.

BACKGROUND

There are a number of different foodstuffs that are provided in sealed cylindrical containers which have a removable cap that can be remounted to reseal the container. Some of these containers are used to contain items such as: manufactured potato chips (including manufactured corn chips or other types of food chips); olives; pickle slices; and other commodities stored in the containers in one of a dry form (e.g., potato chips) or immersed in a liquid bath (e.g., olives). (in general, manufactured potato chips are formed from potato flakes into a uniform size and shape. Other similar manufactured food chips are formed in a similar manner.) As many have experienced, when eating manufactured potato chips which are packaged in this manner, the relatively small tubular size used to laterally contain the potato chips in a stacked configuration is relatively small in diameter and this makes it difficult to manually extract the chips after a portion have been previously removed.

One problem many people encounter with such containers (with respect to manufactured food chips) is that as the manufactured food chips are removed and what becomes the top chip recedes downwardly, the chips become increasingly difficult to grasp. This leads to shaking of the container and upsetting it to obtain the contents. This results in breakage of the chips and then the broken chips are usually poured out onto one's hand and small pieces of the chips pass may through the hand and onto the floor.

Further, foodstuffs immersed in a liquid bath typically have a specific gravity heavier than water, and thus such foodstuffs tend to sink to the bottom of the container. Thus, after the foodstuff presented near the top of the container has already been extracted, the user may have difficulty in extracting the remaining foodstuffs from the container. This problem is particularly noteworthy when the foodstuff is olives, or other similarly shaped foodstuffs. Specifically, olives are generally round or elliptical in shape, and thus attempting to extract such foodstuffs from the lower reaches of a container by the use of a fork or the like results in the foodstuff rolling off of the fork and back into the liquid bath in the container. Furthermore, many cylindrical containers for containing foodstuffs such as olives and the like tend to have a relatively high height-to-diameter ratio. (it is not uncommon for an olive jar to have a height of two or three times the diameter of the jar.) This high height-to-diameter ratio makes it even more difficult to extract foodstuff from the lower reaches of such a container. One exemplary olive jar has a height of 13 cm, and an opening of 4.5 cm (thus, an effective height-to-diameter ratio of 2.9. Further in this example, the olives stored in the jar have an average length of 3 cm, and an average length of 2 cm. (Thus, a clearance of only 1 cm is allowed for extracting olives from the mouth of the jar.) If the user applies a salad fork having a width of 2.5 cm, and an angle between the tines of the fork and the handle of the fork of 30 degrees, the user is essentially incapable of extracting one of the olives from the container using the fork, short of piercing the olive with the fork. (This example is based on the Williams-Sonoma® 5 oz "Martini Olives", 2011, and the Yamazaki Hafnia salad fork.) Consequently, the only way in which a user can extract such an olive from such a jar using such a salad fork is to pierce the olive with the salad fork. This is an undesirable method since it tends to mutilate the olive, leaving it unpresentable for use in a martini cocktail. Further, it can in fact be very difficult to pierce an olive in the lower portion of an olive jar, since the olive will tend to slip away from the tines of the fork.

In yet another application, large diameter pickle slices are commonly contained in a cylindrical container in a stacked configuration. While easier to extract from the container than olives (for example), the user must still either (1) pierce the pickle slice with a fork or the like, or use fingers to extract the pickle slice from the container. In either event the user must then allow retained liquids to drain away from the selected pickle slice over the container, or otherwise risk dripping the liquids outside of the container.

U.S. Pat. No. 7,544,294, issued Jun. 9, 2009 (hereinafter, "the '294 patent") provides as follows:

> " . . . a container 10 includes a vessel 12 having generally cylindrical walls and a wide opening proximate the top thereof. A slider 14 is positioned within the vessel 12. The slider 14 typically extends across substantially the entire area of the vessel 12 and either contacts the inner walls of the vessel 12 or leaves a small gap therebetween. The slider 14 engages a shaft 16 extending vertically through a substantial portion of the height of the vessel. The shaft 16 bears threads 18 and rotatably secures to the vessel 12 near a floor of the vessel 12. A threaded portion 20 is secured to, or formed on, the slider 14 and engages the threads 18 of the shaft 16. In the illustrated embodiment, the threaded portion 20 is embodied as a collar secured to a substantially planar slider 14." (Col. 1, line 60 through Col. 2 line 4.)
>
> "A grippable member 24 secures to the shaft 16 to facilitate gripping by the hand of a user. The user grips the grippable member 24 with the hand to rotate the shaft 16. The engagement of the threads 18 with the threaded portion 20 causes the slider 14 to translate up or down." (Col. 2 lines 17.21.)
>
> " . . . the grippable member 30 is located beneath the vessel 12." (Col 2 lines 28-29.) "A seal 34 secured to the floor 36 of the vessel 12 inhibits leakage of fluid from the vessel 12. (Col. 2 lines 36-37.)

As can be seen from FIGS. 1 and 2 of the U.S. '294 patent, the apparatus disclosed therein is impracticable for use with foodstuff having a diameter of 50% or more of the diameter of the container ('vessel', 12). Thus, for example, the apparatus is impracticable for storage of items such as large diameter pickle slices (i.e., pickle slices having a diameter of greater than 50% of the diameter of the container), since the central shaft (16) would inhibit storage of such foodstuffs within the container. Furthermore, the storage capability of the apparatus described by the '294 patent is inherently limited (by virtue of the presence of the central staff 16) to items having a maximum width of less than 50% of the diameter of the container. While FIG. 2 of the '294 patent depicts food items 38 as fitting comfortably in the area between the central shaft 16 and the inner wall of the vessel 12, it will be appreciated that in order for this depicted configuration to occur, (1) the size of the food items 38 must be restricted to be less than 50% of the diameter of the vessel 12, and (2) the diameter of the vessel must be increased to greater than 50% of the size of the food items. (That is, the design of the '294 patent does not allow for food items having a diameter greater than 50% of the diameter of the vessel to be stored there within.)

Furthermore, in the design of the '294 patent, the food items 38 generally remain stationary with respect to the rotationally moving central staff 16 during operation. Consequently, the food items 38 are subjected to: (i) frictional wear with the central shaft during operation thereof; and (ii) possible binding with the treads 18 of the central shaft during operation thereof.

The design of the apparatus disclosed in the '294 patent is also subject to compromising a vacuum seal within the vessel 12 by virtue of the seal (34) between the actuator 24 (and shaft 16) and the floor (36) of the vessel. That is, over time the seal 34 can become dry if the container is stored for a length of time prior to use, and can thus allow air to enter the vessel. Likewise, over time the seal 34 can become dry if the shaft (16) is not rotated periodically with respect to the seal (34), and thus fluid within the container can leak from the container.

Such problems also exist with other products with respect to tubular containers. Such products can include corn chips, cookies, crackers, dough, other food items, and non-food items.

Other prior attempts to address these problems have been to shorten the height of the containers. While this solution improves access to some degree, it can significantly increase the costs associated with packaging. (For example, one company well-known for this type of packaging for potato chips has come out with a six-pack of small containers which are short enough to allow easy access. However, each of these reduced size packages has to be filled, safety sealed and provided with an individual cap and canister. This is demonstrative of the level of ordinary skill in this art. Other approaches may also have been attempted, but to date none has fully addressed the problems to the complete satisfaction of consumers. Concerns about these issues have been expressed for many years to those choosing to package products in this manner. Some manufacturers have not adopted this type of product and packaging because of consumer frustration over the breakage of the theoretically "perfect" potato or other chip or foodstuff.

Thus, there has been a long-felt need in the container art for an inexpensive, and/or manually operated dispensing container that provides better access to remove products or product pieces held in a tubular or other suitably shaped container. This need has been particularly acute where the contents are preferably removed by first removing a container cap which is used to seal the container and protect the sealed contents after such contents have been dispensed.

Some or all of the problems explained above and other problems may be helped or solved by the disclosures shown and described herein below. Such disclosures can also be used to address other problems not set out above or which develop or are appreciated at a later time. The future may also bring to light unknown or currently unappreciated benefits which can in the future be recognized or appreciated from the disclosure shown and described herein below.

DETAILED DESCRIPTION

The readers of this document should understand that the embodiments described herein may rely on terminology used in any section of this document and other terms readily apparent from the drawings and the language common therefor as may be known in a particular art and such as known or indicated and provided by dictionaries. Dictionaries were used in the preparation of this document. Widely known and used in the preparation hereof (and without limitation) are Webster's Third New International Dictionary (copyright 1993), The Oxford English Dictionary (Second Edition, copyright 1989), The New Century Dictionary (copyright 2001-2005), Merriam Webster's Collegiate Dictionary, 10$^{th}$ Edition (copyright 1996), and Webster's Third New International Dictionary—Unabridged (copyright 1986), all of which are hereby referenced for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms or features shown in one embodiment that can also apply to, or be combined with, other embodiments for similar structures, functions, features and aspects of the disclosed concepts. The readers of this document should further understand that the embodiments described herein may property rely on terminology and features used in any section or embodiment shown in this document and other terms readily apparent from the drawings and language common or proper therefor.

Wording used in the claims is also descriptive of claimed invention, and the text of both the originally submitted claims, and abstract, are incorporated by reference into the description entirely in the form as originally filed. Terminology used with one, some or all embodiments may be used for describing and defining the technology and exclusive rights associated herewith.

First Embodiment and Some Common Features

General Configuration

Figure 1:
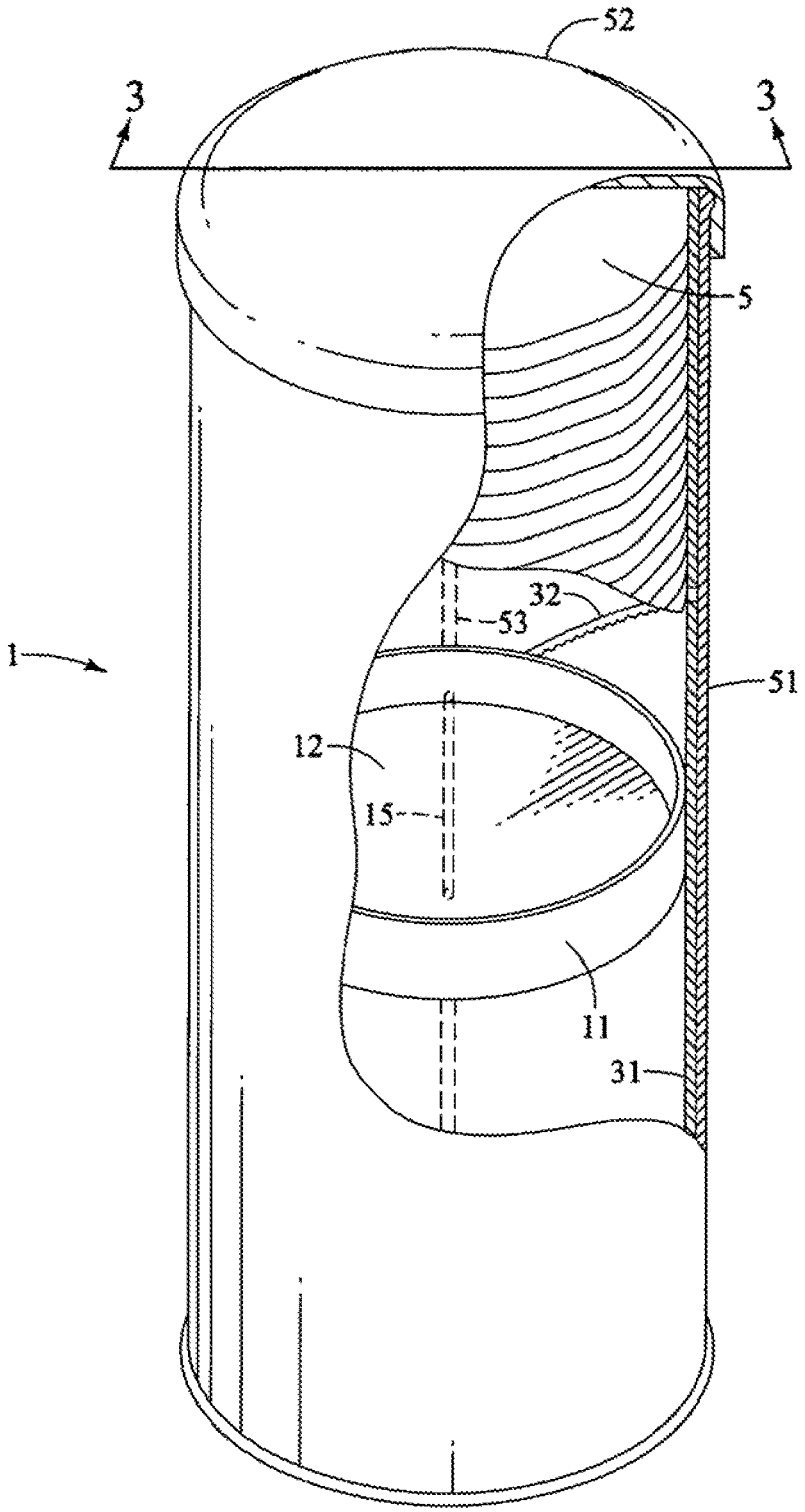
FIG. 1 is a perspective view showing a container having novel features according to the inventions taught herein. A portion of the container has been removed to show additional aspects and features of the inventions.

FIG. 1 depicts a preferred embodiment of apparatus or assembly 1 according to some of the inventions set out herein. Apparatus 1 is used for both containing and elevating contents held within a container body to form a combined container and dispenser apparatus. This apparatus is generally referred to by the reference number 1.

The assembly 1 has an outer piece which forms a container body or canister 51, and a removable cap or other suitable closure 52. The cap or other closure 52 can snap onto and off of the open end of the container body or canister 51. Alternatively, other types of closures having threads, bayonet features or other means adapted for securing the closure to the canister 51 can also be employed. Additionally, there can be a safety seal (not shown) applied after packing the canister 51 to assure the consumer that the container 1 has not been opened and contents removed, tampered with or adulterated in any manner.

An operator 30 (see also FIGS. 5 and 6) is positioned within the container interior and can be manipulated to allow torque to be applied thereto. The operator can include a slot or groove 32 which curves up the side of the operator and engages with a follower 15 extending from the lift 10 (see also FIGS. 2-4). The slot or groove 32 has an upper edge 33 and a lower edge 34. As FIG. 1 illustrates the lower edge 34 can be provided with serrations (37), teeth or other mechanisms, such as simply friction, to help or prevent the lift 10 from descending after the lift is elevated (if such is desired).

The container 1 can also include a longitudinal feature or features which restrict or prevent rotary movement of the end of the follower 15, thus keeping the lift assembly 10 from rotating with the operator tube 31. The operator 30 is turned in the appropriate direction and the lift 10 moves upwardly as the follower 15 is pushed up by the helically curved or otherwise appropriately shaped slot or groove 32. The serrations 37 (described above) can also be configured and constructed to provide resistance to keep the lift 10 at a given elevation, or maintain it at a desired elevation yet allow any retraction into the container 1 which might be desired as depends upon the contents and dispensing and/or sealed containment functions intended for use.

Canister Portion and Closure Cap

The container 1 has a canister portion 51. Canister 51 is preferably tubular in shape. The tubular configuration is desirably provided with a consistent cross-sectional size and shape. As depicted in the figures, the canister 51 is cylindrical. The canister can be otherwise suitably shaped to allow operation of the apparatus 1.

Canister 51 can be adapted to engage with a cap or closure 52 to form a substantially sealed interior when the cap or other closure is installed upon or closed with the canister.

Lift Assembly

Figure 2:
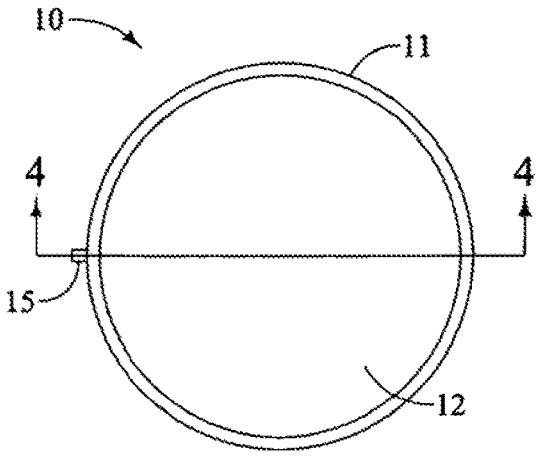
FIG. 2 is a top view showing the interior lift in isolation of FIG. 1.
Figure 3:
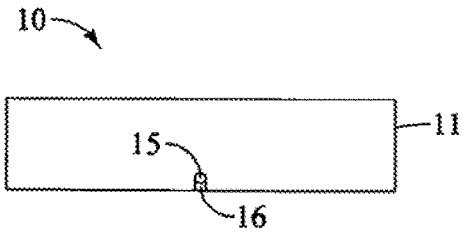
FIG. 3 is a side elevation view of the interior lift of FIG. 2.
Figure 4:
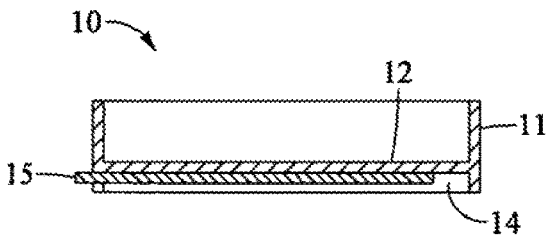
FIG. 4 is a front sectional view taken along line 4-4 of FIG. 2.

FIGS. 2-4 in particular show one preferred lift assembly 10. As shown, lift assembly 10 includes a floor 12 surrounded by an annular sidewall 11, thus forming a void space 13 which can receive food stuffs and other contents stored within the container 1. For example, the floor 12 can support foodstuffs, such as potato chips 5 as shown in FIG. 1, in the void 13. The annular sidewall 11 helps to maintain proper positioning of foodstuff pieces 5 or other contents within the void (and within the container 1 in general) and reduces the risk of breakage or other damage. It also facilitates co-linear sliding within the operator 30, such as operator tube 31.

The lower surface of the floor 12 can be recessed to form a lift bottom recess 14. An aperture 16 allows a rod or other appropriately shaped follower 15 to extend from the lift assembly 10. The follower 15 can be adhered to, otherwise affixed, or be part of the lift assembly 10. The follower 15 is intended to be maintained within a groove 53 (described more fully below).

Lift Operator

Figure 5:
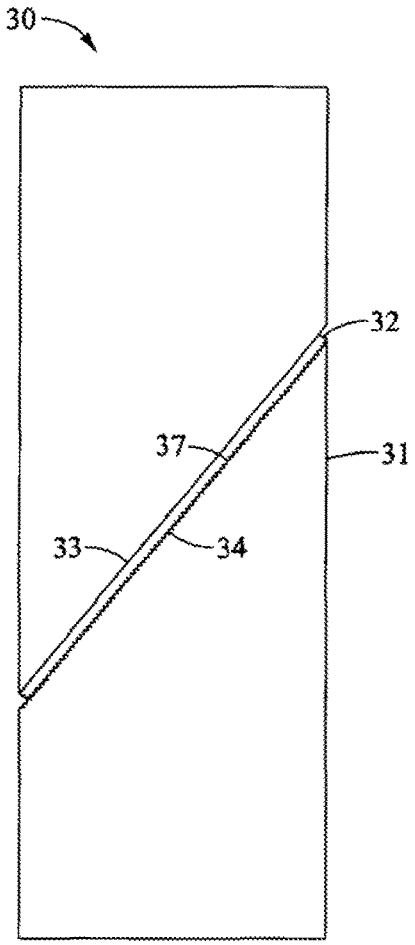
FIG. 5 is a rear view of the operator of FIG. 1 in isolation.
Figure 6:
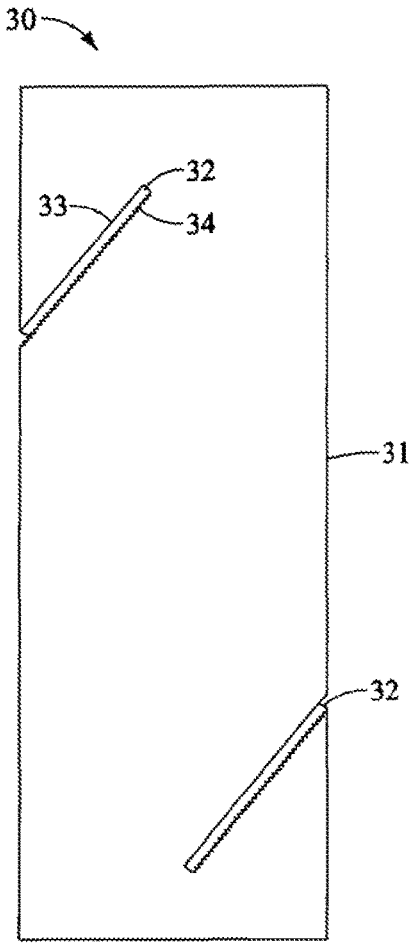
FIG. 6 is a front view of the operator of FIG. 1 in isolation.

The apparatus 1 of FIG. 1 includes an operator 30 (shown in side view in FIGS. 5 and 6). Operator 30 advantageously includes an operator feature for moving the lift assembly 10 up and down. As depicted in the figures, the operator 30 includes a feature which forces the follower 15 (FIGS. 2-4) in response to torque or turning force applied to the operator. As shown, such feature is advantageously in the form of a slot 32 or groove formed in the sidewall of the operator tube 31. The slot 32 shown can include serrated teeth or serrations 37 along the lower portions of the slot. The upper edge 33 of the slot 32 can be smooth or otherwise desirably shaped. The extending portion of the lift follower 15 is engaged with the operator slot or other suitable feature, thus moving the lift assembly up or down as the operator tube is rotated.

To facilitate smooth action, the operator 30, and the operator tube 31, are preferably cylindrically shaped (as depicted in FIGS. 5 and 6) for rotary and/or longitudinal movement within the interior cavity of the canister 51. In this way the operator 30, and operator tube 31, can be described as an inner liner which is concentric with, and located adjacent to, the inner wall of the canister 51. The operator tube 31 can thus be described as an inner canister, with the canister 51 being an outer canister. The operator tube 31 can also be described as an inner sleeve, or an inner hollow cylinder, with the canister 51 correspondingly being described as an outer sleeve, or an outer hollow cylinder. Preferably, the outer wall surface of the operator tube 31 is located between about 0.5 mm and about 5 mm from the inner wall surface of the canister 51. More preferably, the outer wall surface of the operator tube 31 is located between about 1.5 mm and about 3.5 mm from the inner wall surface of the canister 51. As can be appreciated, the operator tube 31 thus forms a cylindrical hollow inner tube which is disposed in close proximity to the cylindrical hollow outer tube of the canister 51. Alternative mechanical operators are also possible. For example, in one variation described below the operator is not cylindrical in shape.

Lift Anti-Rotation Features

Canister 51 advantageously includes a lift anti-rotator in the form of guide feature 53 (FIGS. 1, 9, 10 and 11) defined along an inner or inside wall of the canister 51. As depicted in the figures, the guide feature 53 can be a groove which receives the distal end of the follower 15 (see FIG. 10). The guide 53 keeps the lift assembly 10 from rotating as the operator 30 is turned (i.e., rotated with respect to canister 51) to raise or lower the lift assembly within the canister (e.g., compare FIGS. 10 and 11). This allows the operator slot or groove 32 to move the lift assembly 10 elevationally as the operator 30 is rotated with respect to the canister 51.

Figure 7:
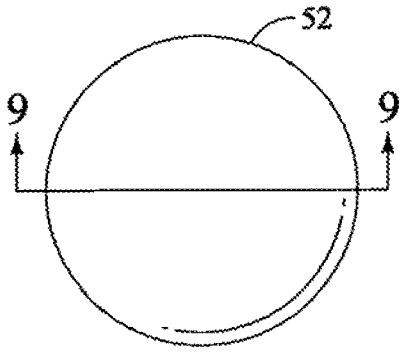
FIG. 7 is a top view of the container structure of FIG. 1.
Figure 8:
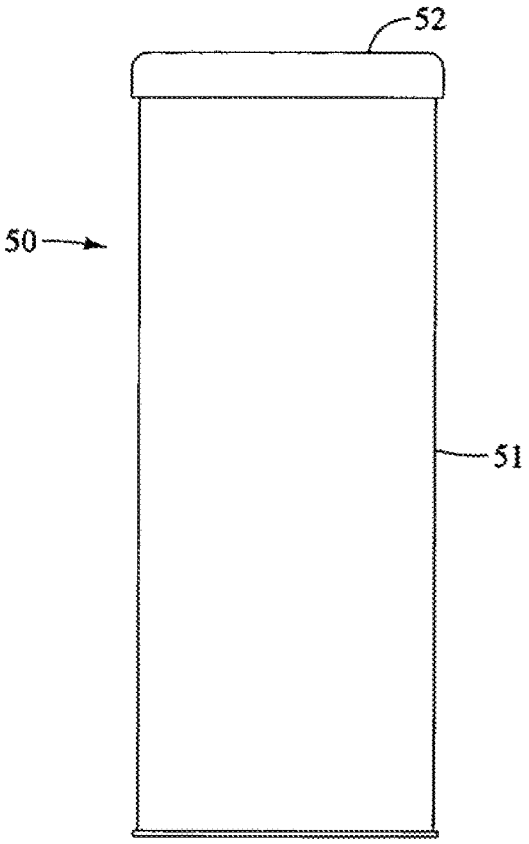
FIG. 8 is a front view of the container of FIG. 1.
Figure 9:
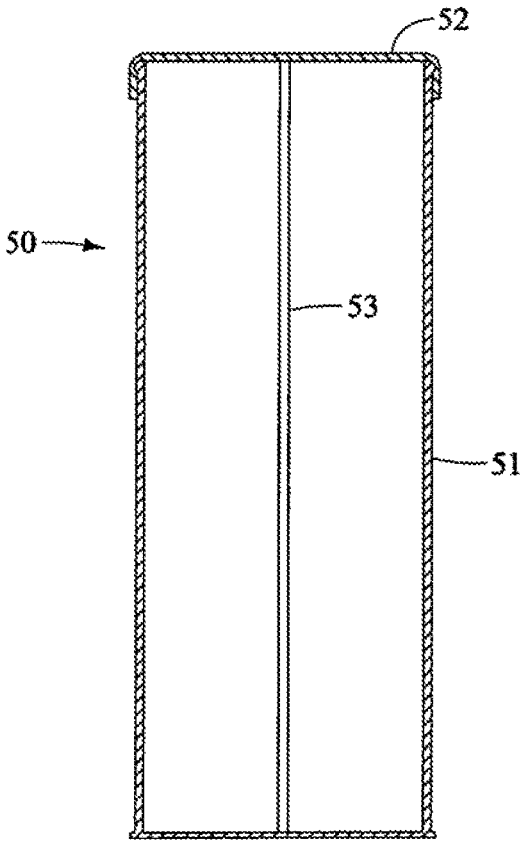
FIG. 9 is a sectional view taken along line 9-9 of FIG. 7.

FIG. 7 is a plan view of the apparatus 1 depicting the closure 52 in place on the top of the canister 51, and further indicating section lines for FIG. 9. FIG. 8 is a side elevation view of the apparatus 1. FIG. 9 is a side elevation sectional view of the apparatus 1 depicting the guide 53 within the canister 51 (but omitting the details of the lift 10, and the operator 30, of FIG. 1).

With respect to FIGS. 1-11, the apparatus 1 operates as follows. Lift 10 is disposed within operator tube 31, and operator tube 31 is disposed within the cylindrical canister 51. (That is, there is a layered configuration, from outer to inner, of canister 51, operator tube 31, and lift 10.) As operator tube 31 (positioned between canister 51 and lift 10) rotates with respect to canister 51, the lift 10 is caused to move upward within the operator tube. More specifically, the follower 15 (which is secured to the lift 10) is placed through the groove 32 of the operator tube 31, and the end of follower 15 is further positioned within guide 53 of the canister 51. Thus, as the operator tube 31 is rotated by a user (while holding the canister 51 stationary with respect to the rotating operator tube 31), the follower 15 follows along the path of the helical groove 32, while, and at the same time, remaining stationary with respect to the canister 51 by virtue of guide 53 (which is a feature formed on the canister 51). In this way as the operator tube 31 is rotated with respect to the canister 51, the lift 10 follows the upward curving path of the groove 32, and the lift 10 (as constrained by guide 53) is moved upward with respect to the canister 51. During this upward movement of the lift 10, the lift remains essentially rotationally stationary with respect to the canister 51. That is, in the first embodiment (depicted in FIGS. 1-11) the lift 10 and the canister 51 remain essentially rotationally stable with respect to one another when the operator tube 31 is being rotated. Put another way, as the user rotates the operator tube 31 with respect to the canister 51, this rotation of the operator tube 31 causes the lift 10 to move upward (or downward, depending on the direction or rotation of the operator tube) within the operator tube 31, during which time the lift 10 remains essentially rotationally stable with respect to the canister 51. That is, the canister 51 and the lift 10 are essentially rotationally fixed to one another (by virtue of engagement of follower 15 (on lift 10) to the guide 53 on canister 51). Thus, the operator 30 acts as the intermediary component (disposed between the inner wall of the canister 51, and the outer wall of the annular sideway 11 (FIG. 4)) to cause this essentially rotational stationary effect between the canister 51 and the lift 10.

Second Embodiment

Figure 11:
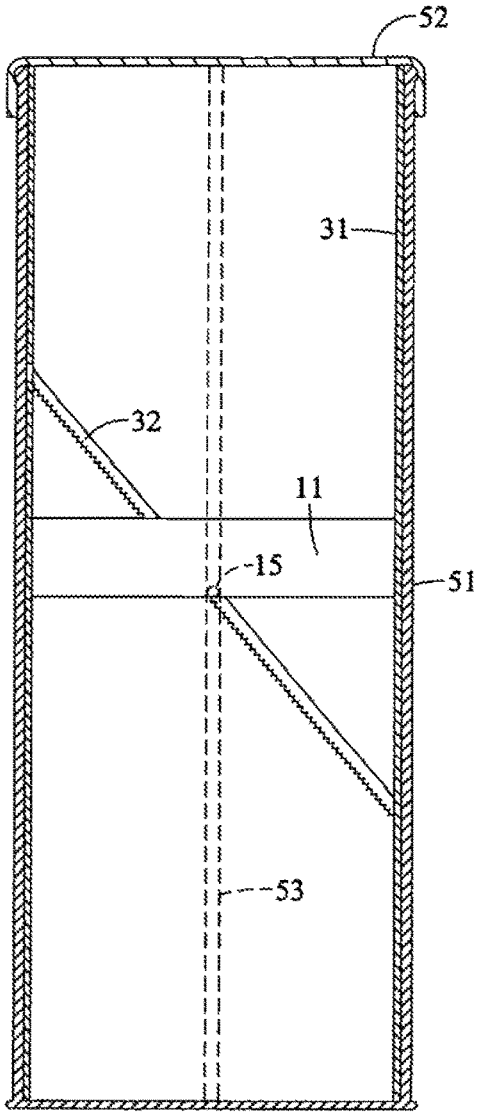
FIG. 11 is a sectional view showing the assembly of FIG. 1 with the elevator lift in a partially raised position relative to the position of FIG. 10.
Figure 12:
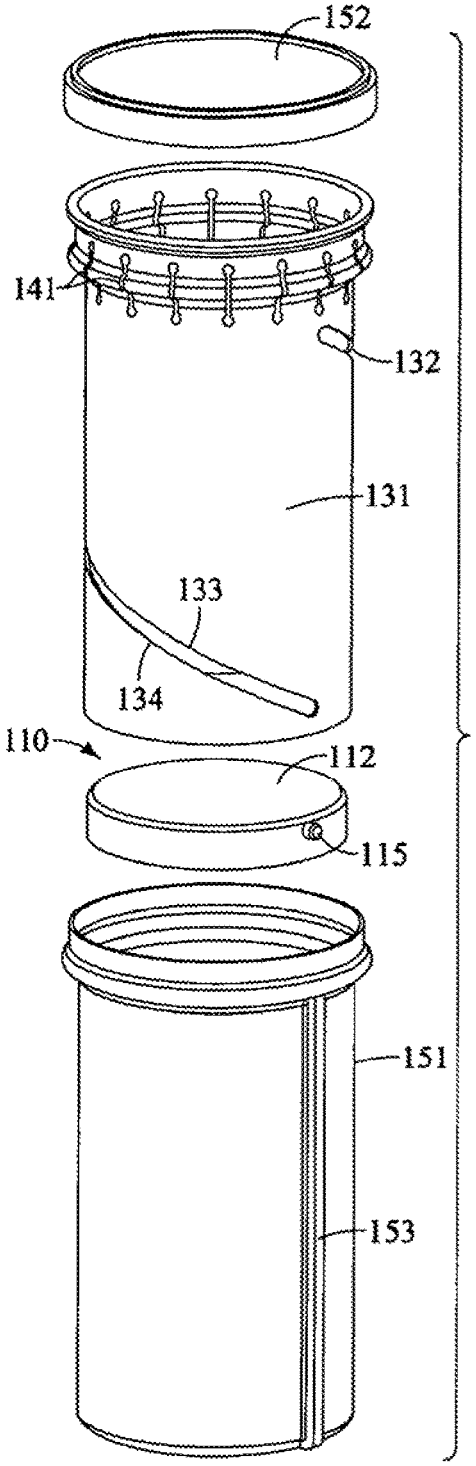
FIG. 12 is an exploded view of a second embodiment implementing features and aspects of the inventions described herein.
Figure 13:
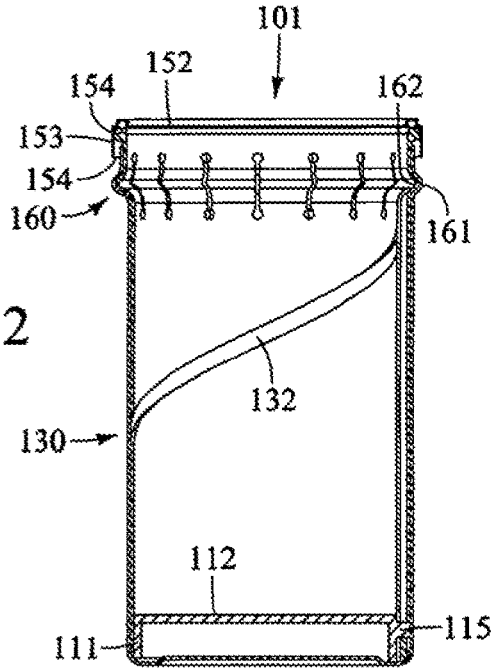
FIG. 13 is a sectional view of the assembled container shown in the embodiment of FIG. 12.

Generally:

FIGS. 12 and 13 depict a second embodiment according to the disclosures provided for herein. Corresponding features used in the container and dispenser apparatus 101 (FIGS. 12 and 13) are labeled using reference numbers that are the same as used in the first embodiment (i.e., apparatus 1 of FIGS. 1-11), but with "100" added to the features described with respect to (e.g., "canister 51" of FIGS. 1-11 now becomes "canister 151" with respect to FIGS. 12-13, and so on). Thus, such common features to both apparatuses 1 and 101 will not be repeated for sake of brevity. Significantly differing features included in the apparatus 101 (FIGS. 12-13) will now be described in greater detail.

Canister

Canister 151 (FIGS. 12 & 13) is similar to canister 51 (FIGS. 1 & 8-11) but modified by providing a canister groove or furrow 161 that preferably extends about the periphery of the canister 151. As shown, this is implemented by placing the furrow 161 near the upper portion of the canister 151. The function of this modification is further described below.

Canister 151 can also include a guide 153 (FIGS. 12 & 13) which is also described in further detail below.

Cap or Closure

FIGS. 12 and 13 show that the cap 152 or other suitable closure is somewhat differently shaped than cap 52 (FIGS. 1 & 7-11). Cap 152 is advantageously provided with a seal 154. Seal 154 and cap 152 are constructed so as to retain the seal 154 in position within the cap by a peripheral wall having an inward extension 155. Seal 154 can be a flexible or resilient seal which can be made of a variety of suitable materials, in particular food grade elastomeric materials in the form of an O-ring. A variety of suitable materials are known in the art.

Lift Assembly

FIGS. 12 and 13 show a modified lift assembly 110. Lift assembly 110 has a floor 112 which is at or toward the top of the lift assembly, with a cylindrical side wall 111 depending therefrom. A follower 115 extends outwardly from the sidewall 111, and the follower 115 is received in the camming slot 132 (in lift operator 131) in a manner similar to the first embodiment describe above.

Operator

Apparatus 101 operates in a manner very similar to apparatus 1. It differs therefrom with regard to the longitudinal retainer described in detail below. FIG. 12 indicates that the operator 131 includes a camming slot 132 with serrations (not illustrated) along the lower portion 134 of the slot 132. The upper edge 133 of the slot 132 is spaced from the lower portion 134 by a distance that allows the follower 115 to be moved by tubular operator 131. Cam slot 132 thus forces the lift assembly 110 to move upward as the operator tube 131 is rotated in a clockwise direction with respect to the canister 151 (as viewed in a top view of the apparatus 101).

The follower 115 (FIGS. 12 & 13) is held in the guide 153 by virtue of retainer 160, and thus the lift assembly 110 is forced to move upwardly when the operator tube 131 properly turned with respect to the canister 151. The lift assembly 110 does not rotate with the tubular operator 131 because of the engagement between the follower 115 and the longitudinal retainer 160.

Longitudinal Retainer

Another aspect that the second embodiment differs with regard to the first embodiment is by including a longitudinal retainer 160 (FIG. 13). The longitudinal retainer 160 helps to retain the operator tube 131 in proper longitudinal position relative to the canister 151. As depicted (FIGS. 12 & 13), this is provided by having the canister retainer groove or furrow 161 formed along the interior wall of the canister 151. In the embodiment illustrated, the retainer furrow 161 is provided by having the canister wall formed to a larger diameter at both the interior wall and exterior wall of the canister 151. Other configurations can also be suitable.

The longitudinal retainer 160 also includes a projection 162 (FIG. 13) formed about the tubular operator 131. Other complementary relationships can also be used relative to the canister 151 and operator 131 to help the longitudinal position to be maintained in a nearly or totally restrained condition to aid operation and also possibly help prevent breakage of fragile contents (such as potato chips).

Tubular Operator Flexibility Features

To allow assembly of the tubular operator 131 into the canister 151, the upper portion of the operator has not only the projection 162, but also flexibility slots 141. Slots 141 are provided at various circumferential positions to provide the needed flexibility so as to allow assembly of the operator tube 131 into the canister 151. Once assembled, the slots are captured by the furrow 161.

Third Embodiment

Plural Camming or Operating Features

Figure 14:
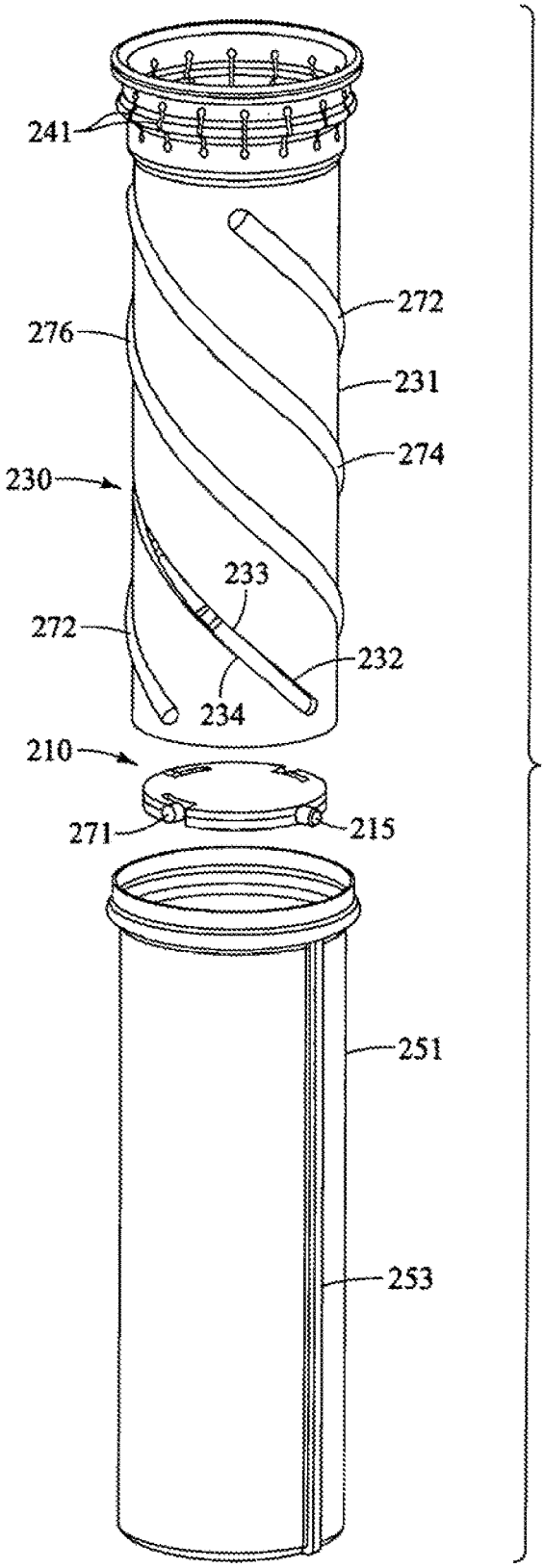
FIG. 14 is an exploded view of a third embodiment implementing further features and aspects of the inventions described herein.
Figure 15:
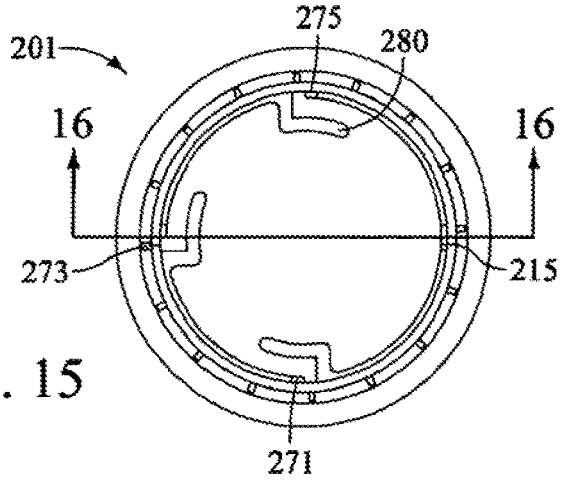
FIG. 15 is a top view of the third embodiment of FIG. 14.
Figure 16:
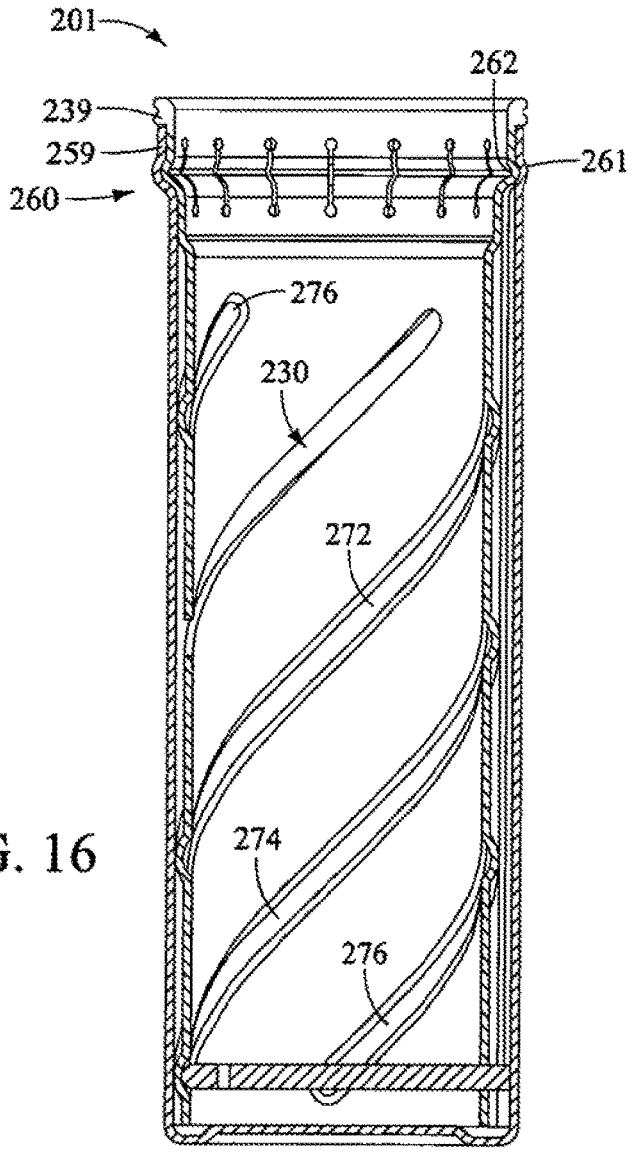
FIG. 16 is a sectional view taken along line 16-16 of FIG. 15.

FIGS. 14-16 illustrate a third embodiment of an elevating lift dispenser and container in accordance with the current disclosure. Apparatus 201 is constructed in most respects similar to the second embodiment 101. Similar features with other embodiments are numbered similarly except they have 200 added thereto and are therefore not repeated in their description.

The primary differences are with regard to having a plurality of camming features. The plural camming features are used to aid or improve in balanced operation of the lift assembly.

As shown, apparatus 201 has not only a camming or operating slot 232, but also one or more camming or operating features 272, 274 and 276. The features 272, 274 and 276 are in the form of grooves which receive the alignment projections 271, 273 and 275 which are on lift 210 (FIG. 15). The projection 215 (also on lift 210) extends through a slot 232 which is open through the operator tube 231. As the operator 231 is rotated or otherwise moved, then force is transferred from the operator to the lift 210, and the lift is moved upwardly with plural points of force application. The plural points of force application are preferably spaced about the operator 231 and the engagement locations. More preferably, the plural points of force application between the operator 231 and lift 210 are approximately evenly spaced, such as at approximately evenly spaced angular positions about the operator when in the form of a tubular operator. As FIG. 15 indicates, this can be conveniently done at approximately 90 degree angularly spaced positions. Alternatively, other numbers of force application and engagement positions and configurations made be used as is suitable to provide the degree of smoothness is operation as desired.

Lift Assembly with Plural Guide Extensions

FIGS. 14-16 further show that the lift assembly 210 is constructed to provide an anti-rotation extension 215 which is received in a guide tract 253. Additionally, the lift assembly has plural guide extensions 271, 273, 275 at spaced positions about the lift assembly as explained above. As shown the guide extensions are spaced at quarter points of the lift assembly when combined with the anti-rotation extension 215. The plural guides can be spaced at approximately equal angular positions. This configuration provides the operator tube with application of force more equally distributed about the lift for smoother operation.

In the version depicted in FIG. 15, the extensions 271, 273 and 275 extend from mounting arms (not numbered) which are defined by cutout regions 280. The mounting arms provide dimensional flexibility which facilitate assembly and operation of the lift assembly 210 into and by the operator tube 251.

In another aspect it will be appreciated that by using only one slot 232 and other camming features 271, 273 and 275 which are solid, then the strength and structural rigidity of the operator, such as operator tube 230, can be maintained at a higher strength and rigidity for a given amount of material used.

Lift Position Indicator

FIGS. 14-16, and FIG. 16 in particular, show that the operator tube 230 can have an upper end or brim 239 which extends longitudinally beyond the upper end 259 of the canister portion 251 (FIG. 14). This extended brim 239 can be marked with a suitable arrow, line or other indicator which is moved relative to a canister indicator on end 259 to provide a visual indication of the approximate relative position of the operator tube 231 in relation to the canister 251. Exemplary indicator markings can be included that indicate the canister is full, at some intermediate position, or near the top for the convenience of the user.

Fourth Embodiment

Figure 17:
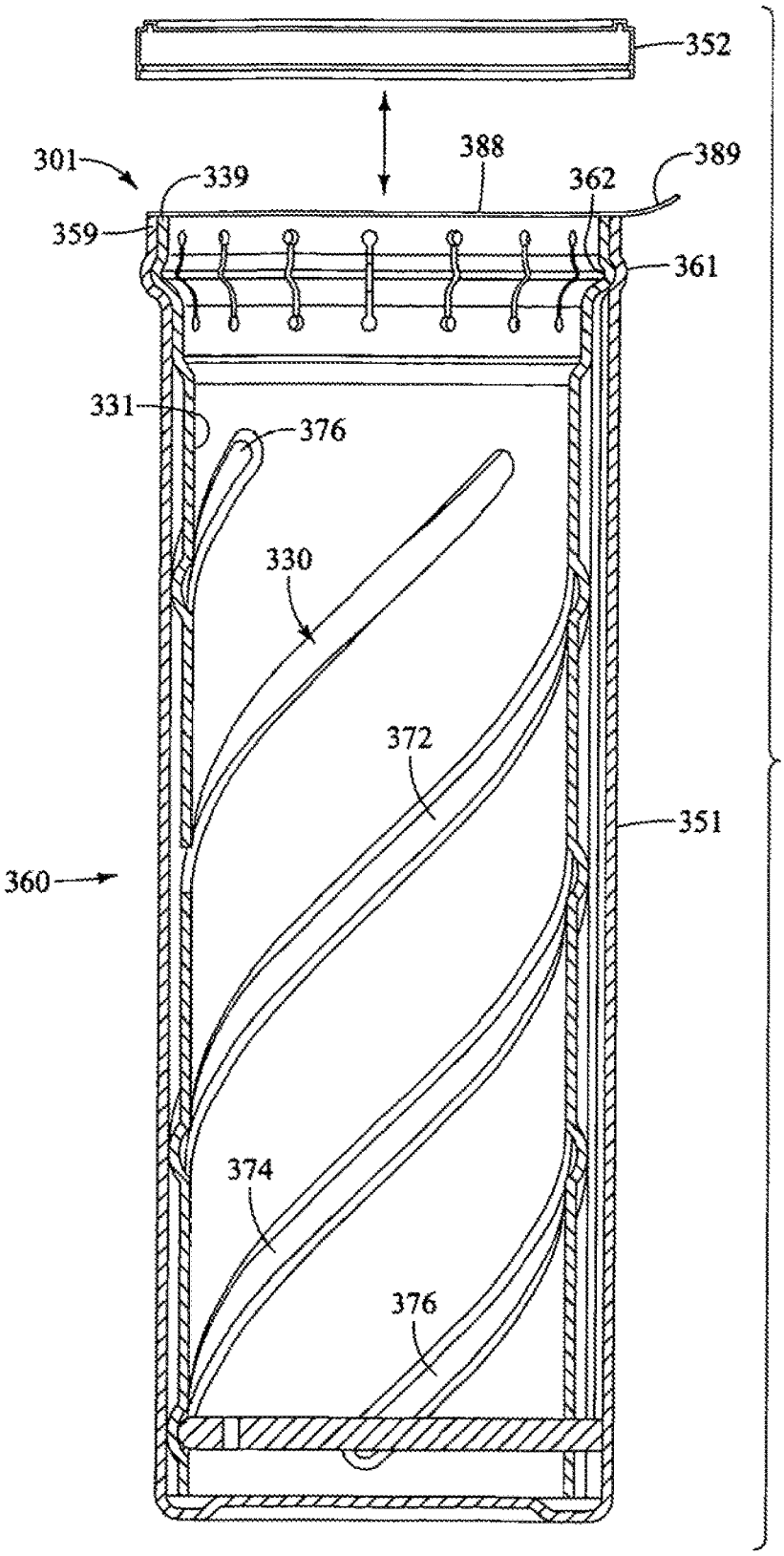
FIG. 17 is an exploded sectional view of a fourth embodiment according to inventions hereof.

FIG. 17 depicts a fourth embodiment 301 otherwise like the third embodiment 201 except as described next. Similar features with other embodiments are numbered similarly except they have 300 added thereto and therefore not repeated in their description.

Operator Tube

Fourth embodiment 301 has an operator tube 331 and canister 351 which have top edges 339 and 359, respectfully, which extend about the opening. The top edges are advantageously made so that they are at, or nearly at, the same position with regard to their longitudinal position. Thus, in this embodiment the operator 331 tube does not extend outside the canister 351.

Safety Seal

The fourth embodiment can also advantageously include a safety seal 388 which can include a removal tab 389. The safety seal 388 can be adhered otherwise suitably attached to the upper ends of the operator tube 331 and canister 351. A removal tab 389 is advantageously included to allow a user to manually grasp the safety seal 388 and pull it from the apparatus to reveal the opening. The safety seal 388 is intended to prevent tampering or adulteration of the contents. It is removed upon initial or first opening and then discarded.

Removable Cap

After the safety seal has been initially removed the cap 352 can be used by installing or re-installing it onto the canister 351 and remaining parts of the apparatus to effectively reseal the interior chamber. Cap 352 can be removed to allow removal of the foodstuffs or other contents from the canister 351. Removal of cap 352 also allows a user to manually insert the user's fingers (or otherwise suitable apply force or torque) to the operator and thereby operate the lift.

Fifth Embodiment

Figure 18:
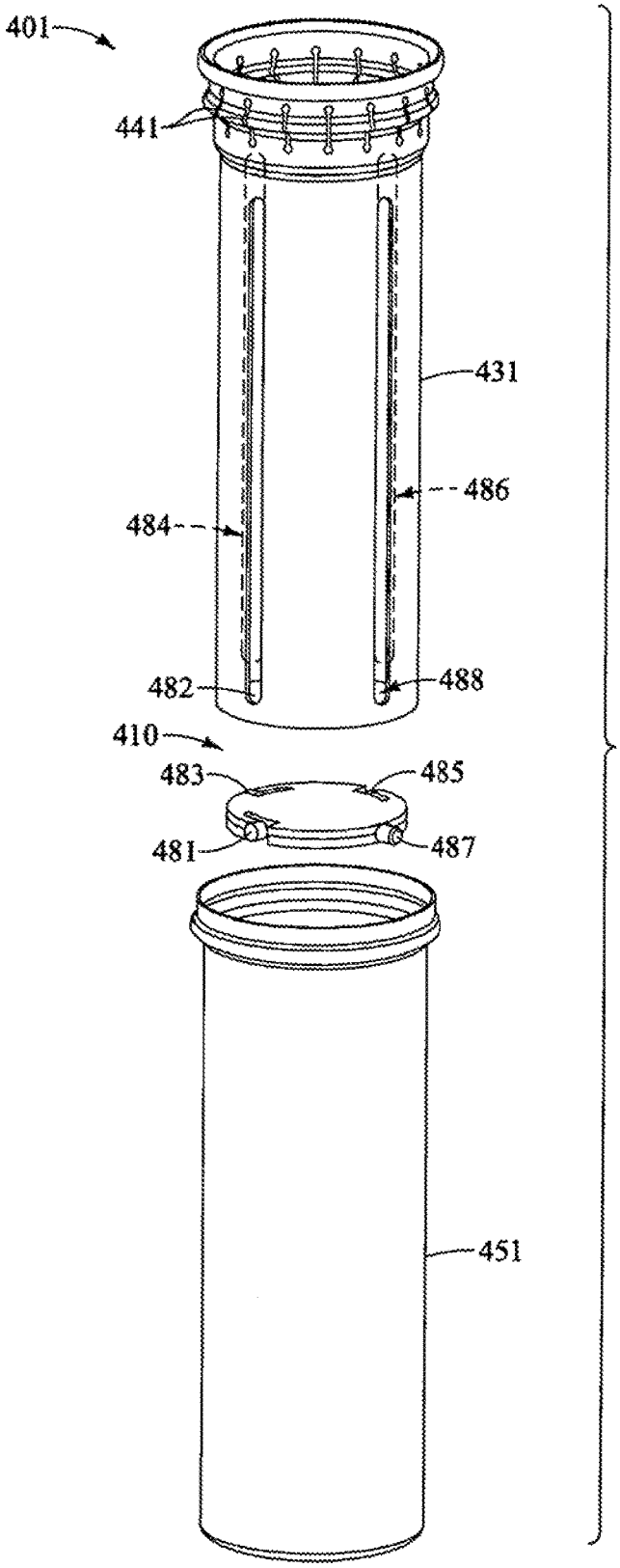
FIG. 18 is an exploded perspective view showing key components of a fifth embodiment according to the inventions hereof.
Figure 19:
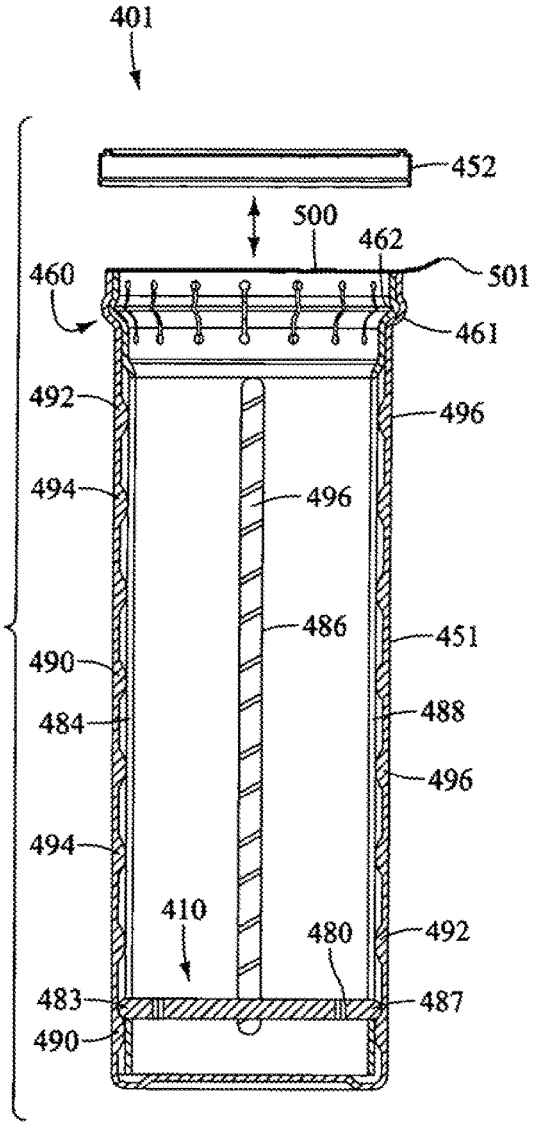
FIG. 19 is an exploded sectional view of the embodiment shown in part in FIG. 8.
Figure 20:
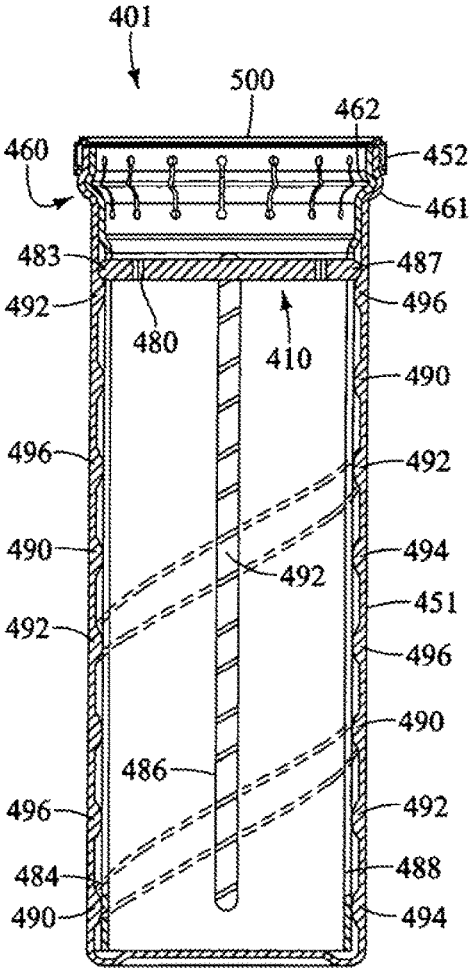
FIG. 20 is a sectional view of the embodiment of FIG. 19 with a cap installed thereon and the lift mechanism moved upwardly relative to the position of the lift as shown in FIG. 19.

FIGS. 18-20 depict a fifth preferred embodiment 401 according to disclosures provided for herein. Similar features with other embodiments are numbered similarly except they have 400 added thereto and therefore not repeated in their description.

Canister

The fifth embodiment apparatus 401 has a lower or canister portion 451 which is similar to the canister 351 of the fourth embodiment. The areas of difference will now be described.

Canister 451 advantageously has a longitudinal restraint feature 461 used to help maintain the relative longitudinal position between canister 451 and the inner member 431. As depicted, the inner member 431 has a projecting rib 462 which extends into a receiving furrow 461 as is explained hereinabove in detail.

Canister 451 differs in that it is provided with features that form part of the operator. More specifically, the canister 451 can have features which function as part of the operator used to move the lift 410.

Canister Lift Operator Features

The preferred features of the canister 451 which serve as part of the operator are advantageously used to force the lift 410. As depicted, this can advantageously be implemented in the form of inwardly extending features, such as the inwardly extending projections which are shaped to help move the lift 410 longitudinally in response to movement, such as rotation of the inner member or tube 431. As depicted, this can be implemented using projections, such as a series of helical projections 490, 492, 494, and 496. Such projections are advantageously formed so as to extend twice around the interior wall of the canister 451. This configuration can also be considered a four lead interior thread configuration which moves the lift 410 from near the low position to the top position after two relative rotations between the inner part or tube 431 and the outer or canister part 451.

Inner Part or Tube

FIG. 18 depicts that the inner part or tube 431 has top features providing the longitudinal retainer 460 as described above specifically the projection 462 that extend into furrow 461 of the outer tube and there are flexibility slots 441 (FIG. 18).

The inner tube 431 is also provided with longitudinal guide slots 482, 484, 486 and 488 which are spaced angularly to receive the projections of the lift 410 which are numbered 481, 483, 485 and 487.

Lift

Contrary to other embodiments the lift in this fifth embodiment provides that the lift 410 rotates with the inner part or tube 431. The lift projections 481, 483, 485 and 487 (FIG. 18) can be mounted on flexible arms on the lift 410, as described hereinabove. The lift projections extend through the longitudinal slots 481, 483, 485 and 487 and are advanced by the interior helical projections 490, 492, 494 and 496 which are formed on the inner wall of the outer tube or canister 451. In operation, the inner part 431 and lift 410 rotate together and the lift moves upward such as between the positions of the lift shown in FIG. 19 to an elevated or extended lift position as shown in FIG. 20. The lift 410 can optionally be provided with perforations (480) in order to allow any liquid to drain from the lift as the lift is moved above the liquid level in the container. One advantage of the configuration depicted in FIGS. 18-20 is that the contents within the container 401 remain static with respect to the lift 410 and the inner tube 431 as the lift moves upward (other than with respect to upward motion). That is, in operation the contents do not rotate with respect to the inner tube 431 and/or the lift 410. This reduces that chance for the contents to be damaged by contacting moving parts.

More about Methods Performed and Manners of Use

Methods Concerning Manner of Use

Figure 10:
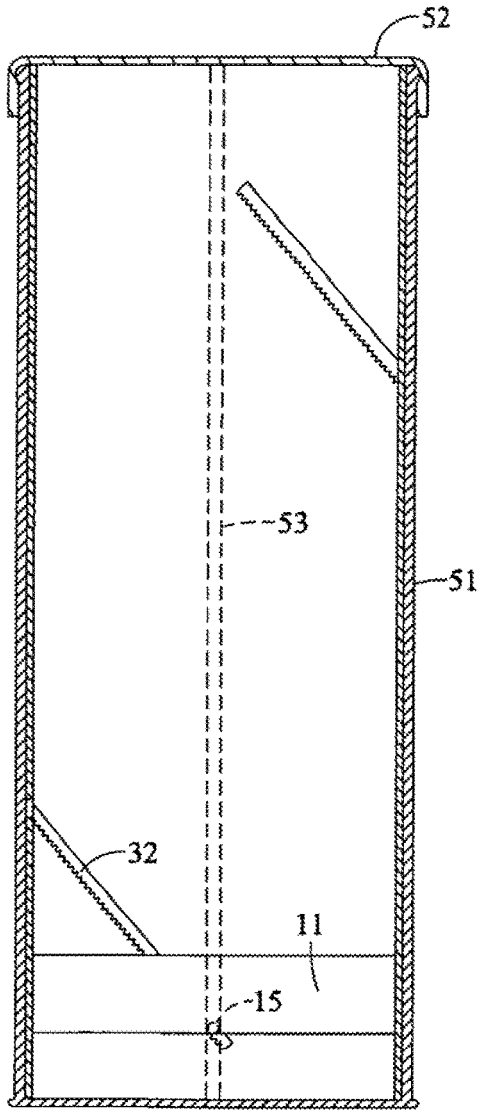
FIG. 10 is a sectional view showing the assembly of FIG. 1 with the elevator lift in a low position.

The invention is typically used by installing the parts into the assemblies depicted and described above. FIG. 10 shows the lift assembly relatively low within the canister 51. Cap 52 is removed and the person operating the apparatus 1 applies torque to the operator 31 which turns in response thereto.

As the follower 15 is held against rotating by engaging with the guide groove or other guide feature 53 the apparatus functions as an anti-rotating mechanism. The follower 15 extends through the cam slot 32 formed in the operator, such as operator tube 31. Turning of the operator 31 is performed by applying torque to the operator. This turning action causes the follower 15 to be forced upwardly or downwardly depending on the direction of rotating movement and shape and slope of the cam slot 32.

Operating the apparatus by turning the operator 31 in the proper direction forces the lift assembly 11 upward. This results in elevating the lift assembly 11 and presenting the contents supported upon the lift assembly to a user in a conveniently available position. Thus the apparatus functions by operating the operator which functions by typically elevating the lift assembly and any supported foodstuffs or other contents.

The operating is preferably performed so as to provide positioning of the lift assembly 11 at an elevation wherein the next chip, treat or other contents are near the top opening of the canister 51. The user then typically uses the device simply by operating the operator 31, such as by rotating the operator tube by torquing the tube or angularly displacing the operator tube.

Although this is preferably done in a simple, inexpensive manually operated device, other implementations are also possible to perform the desired functions and methods of operation. In an exemplary application of use, potato chips 5 (FIG. 1) or other appropriate foodstuffs (such as cookies, crackers, olives and/or other items) are elevated into position for easy manual grasping and dispensing of the foodstuff (or other contents) from the container 1.

Methods according hereto can also include restraining the lift to prevent downward motion. This can be accomplished by using teeth or serrations which perform a catching function. This is advantageously used in preventing the lift assembly 10 (FIG. 3) from inadvertently dropping within the canister 51. The maintaining of the lift assembly 10 can be by serrations 37 (FIG. 5) which retard movement of the follower 15 within the operator slot 32. Alternatively the operator 31 can be prevented from inadvertent movement by properly sizing the operator with respect to the canister 51 to provide frictional restraining of the operator.

As the lift assembly 10 moves up (or theoretically also downward) the follower 15 tends to stay within or against the canister guide feature 53, which performs an anti-rotating function.

Upon removal of the desired contents, the operator 31 can be turned to lower the lift assembly 10 if desired, needed or as allowed depending on the specific embodiment used.

It is noteworthy that the methods are performed with both the contents and operator fully within the inside of canister 51. Thus the methods can further be described as having a opening and closing capability by removing or installing the cap or other closure 52. The cap can be held in position by snap fitting the cap over a top marginal rim of the canister to thus provide an enclosing function which acts by sealing or substantially sealing the interior of the apparatus.

Manner of Use of Fifth Embodiment

According to the fifth embodiment the manners of use and methods performed thereby include selecting an assembly having the features described hereinabove with regard to the fifth embodiment. The methods can further include removing any safety seal, such as the illustrated safety seal 500 (FIGS. 19, 20) as may be facilitated by puling on the tab 501. Once the safety seal 500 has been removed, then the opening of the apparatus 401 is done by removing the cap 452. Conversely, closing or resealing the apparatus 401 is accomplished by installing the cap 452 onto the top of the apparatus and thus substantially sealing or re-sealing the apparatus thus helping maintain freshness of the contents and containing them within the container apparatus.

The operational methods performed include rotating the inner part or tube 431 (FIG. 18) relative to the outer part or canister 451. This also causes rotating of the lift 410. The lift 410 is adapted and positioned such that rotating the tube 431 and lift assembly results in engaging of the lift engagement extensions (481, 483, 485 and 487) relative to the inward features (490, 492, 494, 496) of the outer part or tube 451. The inwardly directed and preferred helices cause the lift engagement features to advance up or otherwise toward the opening through which the contents can be removed. The relative rotating of the two parts causes in practical use lifting of the foodstuffs or other contents upwardly for facilitating manually grasping the contents.

After the lift 410 has been operated by moving and positioning the lift to a desired position then the user may remove the uppermost contents. This is usually done by simply engaging the hands and fingers of the user with the top-most contents and extracting them at the convenient position achieved by adjusting the lift height by turning the inner tube 431 relative to the outer tube 451.

After the user has extracted the contents to the degree or extent desired, then, the methods can include resealing the apparatus 401 by installing the cap 452 onto the open end and occluding the opening in a substantially sealing relationship.

More about Preferred Manners of Making

Other methods according to the current disclosure can include constructing or making or providing a suitable container or containers having the various described features. The container can be made from paper fiber material as is well known in current containers of this type. The making also advantageously includes selecting a canister material that is made by coating or layering the inside, outside or both of the canister with low permeability materials such as aluminum or other metallic coating along the inner wall, outer wall or both. Alternatively, the inner wall, outer wall or both can be made by using other coatings having low air permeability or selecting materials of low permeability to effect maintaining of the flavor of the contents within the container as sold and after resealing with the installing of the cap or other closure.

Alternatively, the apparatuses according hereto can be molded, such as in plastic, glass, and/or appropriate metals (for example) according to known techniques. They can also be fabricated from these and other materials indicated above and equivalents thereof. One suitable form of manufacturing the components of the apparatus is by a technique commonly referred to as blow molding. This in particular can be used in fabricating one or both of the inner tube and the outer canister. Alternatively, the canister can in some or all forms be made using paperboard or mixtures of a variety of suitable materials used and now known or hereafter developed for the packaging industry and the food packaging industry in most applications.

The making processes can also include positioning the lift assembly, (which can be made of suitable materials, such as food grade plastics or paperboard, and can be either coated or uncoated, as needed). The lift assembly (e.g., 410, FIG. 19) can be assembled into the apparatus (e.g., 401) by inserting it into the operator (e.g., 431), such as by inserting the lift assembly into the operator tube as indicated above. The operator (431) can then be further assembled into the apparatus (401) by installing the operator into the canister (451). Optionally, the apparatus can be assembled by applying a safety seal (e.g., 500, FIG. 19) to perform a safety sealing of the contents until the time of sale.

In the embodiments having a longitudinal restraint construction (e.g., longitudinal restraint 461, FIG. 19), the operator (e.g., 431) is assembled by inserting the operator until the longitudinal restraint couples with the complementary furrow (e.g., 461) or restraining feature which is advantageously included during the manufacturing of the canister (e.g., 451).

Sixth Embodiment

Figure 21:
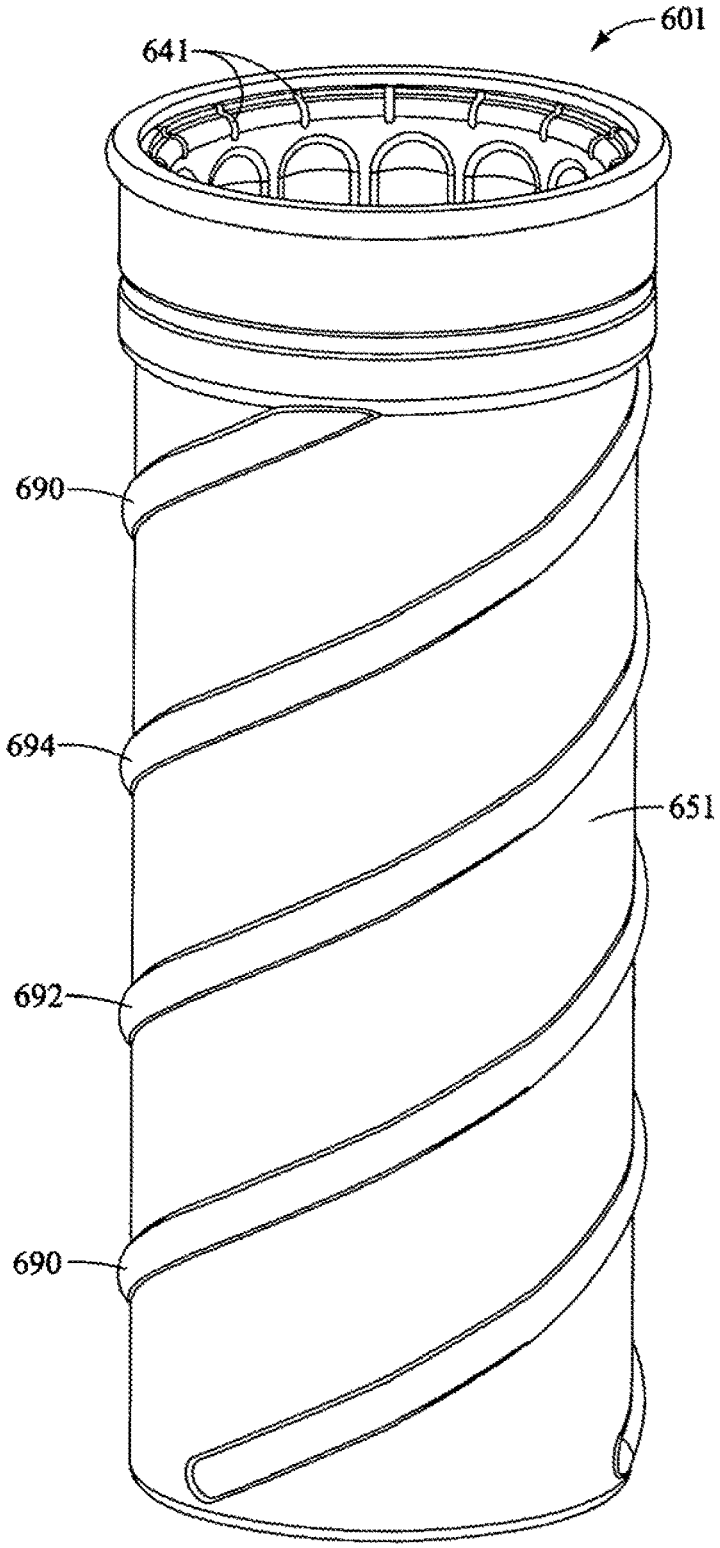
FIG. 21 is a perspective view of a sixth embodiment implementing features and aspects of the inventions described herein.
Figure 22:
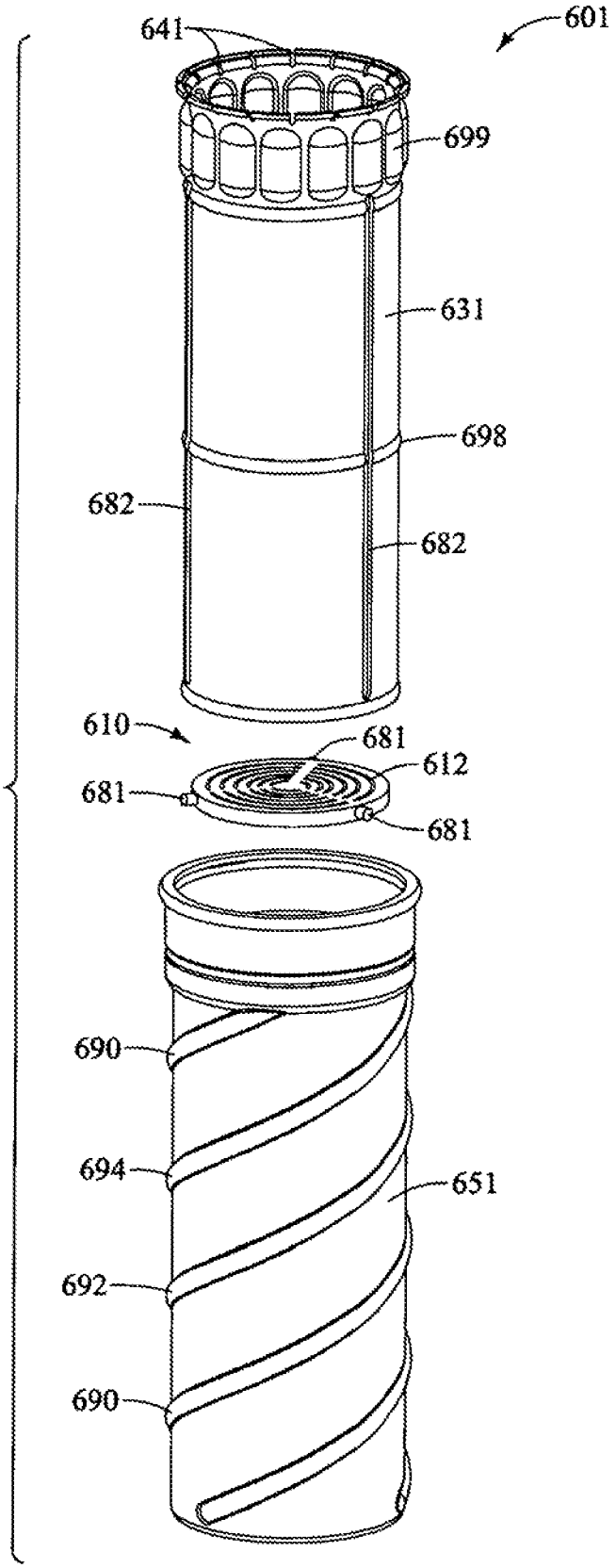
FIG. 22 is an exploded view of the embodiment of FIG. 21.
Figure 23:
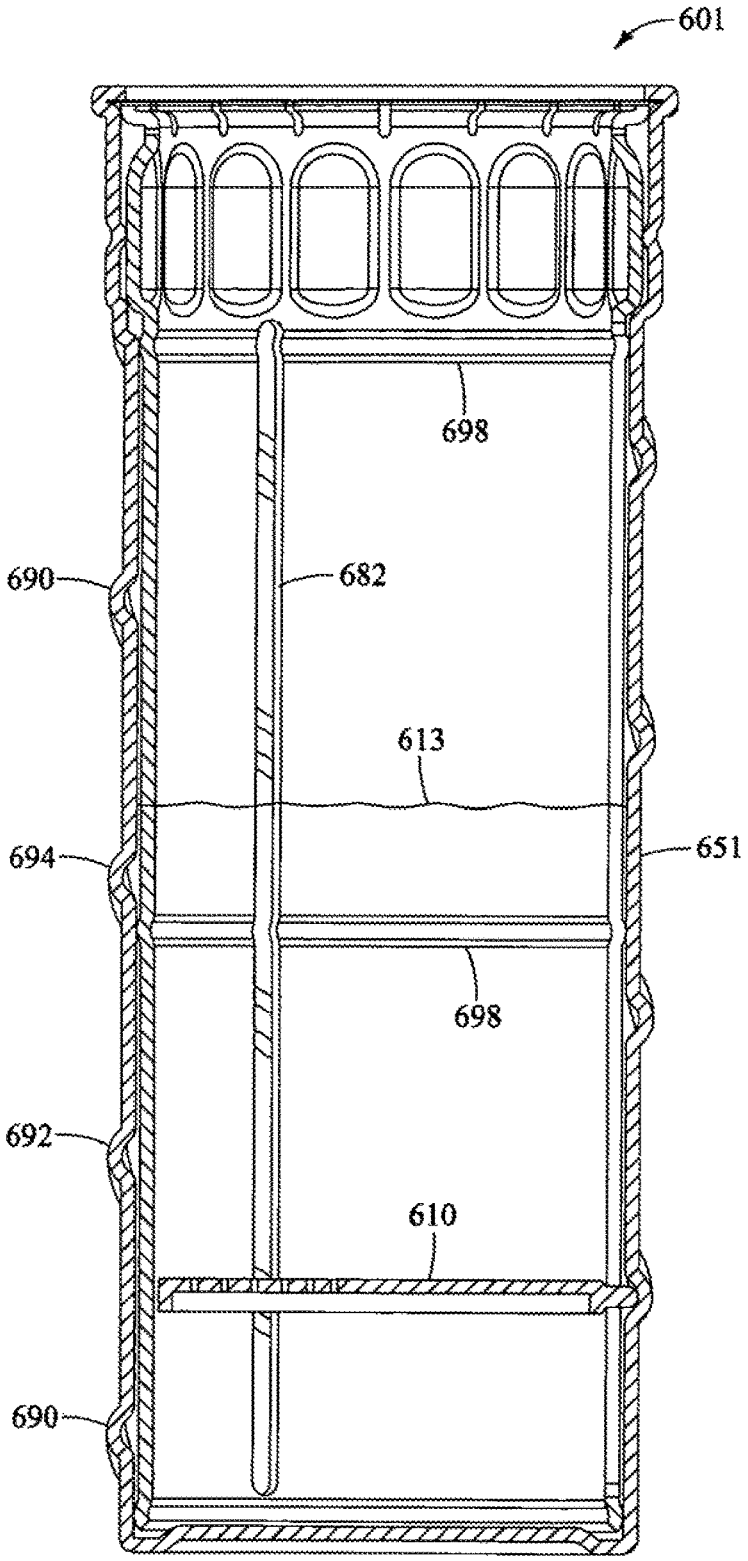
FIG. 23 is a sectional view of the embodiment of FIG. 21.

FIGS. 21-23 depict a sixth embodiment 601 in accordance with the present disclosure. Features of the sixth embodiment are similar to those of other embodiments (and in particular, the fifth embodiment), and are numbered similarly except that they have 600 added thereto. Furthermore, description of certain features of the sixth embodiment similar to those of other embodiments are not repeated herein with the exception of certain features notable to the sixth embodiment.

Container

The sixth embodiment apparatus 601 includes an outer container or canister 651 that can be similar to the canisters of other embodiments described herein. For example, the outer container 651 can be similar to the canister 451 of the fifth embodiment. The areas of difference will now be described.

The outer container 601 can be adapted to contain or store therein articles such as foodstuffs or the like, including (but not limited to) items held in a liquid bath. For example, the container 601 can be adapted to store or contain therein olives, peppers, pickles and the like, which are typically packaged in a liquid brine or other liquid bath suitable for emersion of solid contents. It is to be further understood that the contents of the container 601 need not be edible foodstuffs. For example, the container 601 can be suitable or adapted to store inedible objects.

Inasmuch as the container 601 can be adapted for storing contents held in a liquid bath, the container can be advantageously fabricated from a material and/or in a manner so as to render the container at least substantially liquid proof or leak proof. Specifically, the outer container (or canister) 651 can be a one-piece leak proof component adapted to contain a liquid therein. For storing foodstuffs in general, it is desirable that the outer container 651 be formed such as to eliminate any openings save for the upper opening which allows items to be inserted into, and removed from, the container 601.

The container 601 can include one or more engagement features 690, 692, 694. One or more of the container engagement features 690, 692, 694 can be adapted to receive therein at least a portion of the lift 610. More specifically, one or more of the container engagement features 690, 692, 694 can be configured to receive therein a respective lift projection 681 (FIG. 22). In accordance with an exemplary embodiment, the container engagement features 690, 692, 694 can be in the form of cam features as is explained hereinabove with regard to the other specific embodiments. However, it is to be understood that in accordance with an alternative embodiment not specifically depicted, an engagement feature defined on the canister 651 can be in the form of a longitudinal feature similar to the longitudinal feature 253 depicted in FIG. 14.

As is depicted in FIGS. 21-23, one or more of the cam features 690, 692, 694 can curve up the side of the outer canister 651. In accordance with at least one embodiment of the present disclosure, one or more of the cam features 690, 692, 694 can curve in an approximate helical shape up the side of the canister 651. One or more of the engagement features 690, 692, 694 can be substantially in the form of a groove. More specifically one or more of the engagement features 690, 692, 694 can be substantially in the form of a groove that is molded into the canister 651.

One or more of the engagement features (or cam features) 690, 692, 694 can function at least substantially in the manner of the canister lift operator features described herein with respect to the fifth embodiment specifically, one or more of the cam features 690, 692, 694 can be adapted to engage at least a portion of the lift 610. More specifically, one or more of the cam features 690, 692, 694 can be adapted to help move the lift 610 longitudinally in response to either rotation of the lift 610 or rotation of the inner member (inner liner, or operator) 631. Longitudinal movement of the lift 610 can correspond to lifting or raising of the lift toward the container opening.

One or more of the engagement features 690, 692, 694 can extend at least once around the wall of the canister 651. In accordance with an exemplary embodiment of the present disclosure, the canister 651 includes a first container feature 690, a second container feature 692, and a third container feature 694. The exemplary embodiment depicted in FIGS. 21-23 can thus be considered a three lead configuration. The depicted exemplary configuration is adapted to move the lift 610 from near the low position to near the top position after slightly more than one relative rotation between the inner part (inner liner, or operator tube) 631 and the outer container 651. It will also be appreciated that by providing less engagement features, or configuring the engagement features at a lower pitch, more turns of the operator tube 631 can be required in order to advance the lift 610 from the lowermost position to the uppermost position within the canister 651.

Inner Part or Tube

FIGS. 22 and 23 depict that the inner part or tube 631 can have top features providing a longitudinal retainer 641, which can function and/or can be configured substantially in the manner of the retainer 460 described herein with respect to at least one other exemplary embodiment.

The inner part (inner liner) or operator tube 631 can be provided with at least one engagement feature 682 (FIG. 22). The inner part engagement feature 682 can be in the form of a longitudinal guide feature as is depicted in FIGS. 21-23. More specifically, the inner part engagement feature 682 can be in the form of a longitudinal guide slot. It is to be understood, however, that in accordance with at least one alternative embodiment of the disclosure, the inner part engagement feature 682 can be in the form of a cam feature such as depicted in FIG. 14 and as is described herein with respect thereto. In accordance with the exemplary embodiment depicted in FIGS. 21-23, the inner part (inner cylinder, or operator tube) 631 includes three longitudinal guide features 682 spaced at substantially even intervals about the inner part or tube.

The inner part or tube 631 can include one or more spacing features 698. The spacing feature 698 can provide a slight space or gap between the inner part 631 and the outer container 651, as is evident from a study of FIG. 23. As is also evident, such a space or gap provided by the spacing feature 698 can help to provide a substantially tight fit of the inner part (inner liner) 631 within the canister (outer liner) 651 while also substantially avoiding any resistance, binding, interference or the like, which might otherwise occur as the result of surface-to-surface contact occurring between the inner part and container. As depicted in FIG. 23, there can be upper, medial and lower spacing features 698.

The inner part or tube 631 can include a top feature 699 (FIG. 22). As is depicted in the exemplary embodiment, the top feature 699 can be substantially in the form of a series of outward projections arranged about the upper portion of the inner part 631. The top feature 699 can serve one or more various purposes. For example, the top feature 699 can serve to facilitate grasping or otherwise gaining at least a partial hold on the inner part 631 for the purpose of turning the inner part relative to the container 651. Such turning of the inner part 631 relative to the outer container 651 can result in operation of mechanism to move the lift 610 as is similarly described and depicted herein with respect to the other exemplary embodiments. The top feature 699 can also be substantially in the form of a series of inward projections arranged about the upper portion of the inner part 631.

Lift

In a manner similar to that depicted and described herein with respect to other exemplary embodiments, the apparatus 601 of the sixth embodiment is configured such that the lift 610 is moved substantially longitudinally between a lower and upper position relative to the canister (or outer sleeve, or outer container) 651. Depending upon the specific configuration of the canister 651 and of the inner part 631, such longitudinal movement of the lift 610 can be associated with corresponding rotation of the lift relative to the canister 651, the inner part (operator, or inner sleeve) 631, or both.

In accordance with the exemplary embodiment depicted in FIGS. 21-23, longitudinal movement of the lift 610 is associated with corresponding rotation of the lift relative to the canister 651 and rotation of the lift substantially along with rotation of the inner part 631. The apparatus 601 can be configured such that each of the lift projections 681 (FIG. 22) on lift 610 engages both a respective longitudinal feature (682) and a cam feature (690, 692, 694).

More specifically, in the exemplary embodiment depicted in FIGS. 21-23, the apparatus 601 can be assembled such that each of the lift projections 681 (on lift 610) is projecting through a respective longitudinal slot 682 in the inner part 631, as well as projecting substantially into a corresponding cam feature (690, 692, 694) in the outer container (canister, or outer sleeve) 651. Accordingly, when in such a state of assembly, rotation of the inner part 631 relative to the outer container 651 can cause the lift projections 681 to be advanced along each respective cam groove 690, 692, 694, thereby resulting in longitudinal movement of the lift 610 between a lower and an upper position relative to the canister 651. Detailed discussion and explanation of similar lift mechanisms are described hereinabove with respect to the other exemplary embodiments.

As is seen from a study of FIG. 22, the lift 610 can have at least one drain opening 612. In accordance with at least one embodiment of the present disclosure, the lift 610 can be perforated, wherein the lift 610 can define therein at least one perforation. More specifically, the lift 610 can define a plurality of perforations, openings or apertures therein. As is depicted in FIG. 22, the lift 610 can be substantially in the form of a grate or grating having a plurality of curvilinear openings or slits 612 arranged in series of substantially concentric circular patterns. Alternatively, the lift can simply have sufficient clearance about the periphery to allow draining of the emersion liquid 613 (see FIG. 23).

The lift 610 can be configured to support thereon specific or predetermined types of articles, products, or objects, while also allowing liquid to drain through, off, or around the lift (e.g., by virtue of drain openings 612). Such a configuration can be advantageous when the apparatus 601 is employed for storing articles in a liquid bath. More particularly, such a configuration can allow at least a portion of the articles supported on the lift 610 and within the container 601 to be raised above the upper level of a liquid bath (613) by operation of the lift mechanism 610 to facilitate removal of at least a portion of the articles from the container 601. In accordance with the exemplary embodiment depicted in FIGS. 21-23, a liquid bath is allowed to drain substantially through the lift 610 at least in part because of the lift being configured substantially in the form of a grate or grating having one or more openings (612) defined therein. The inclusion of openings 612 in the lift is also useful when the container 601 is used to hold dry items (such as snack items) to thereby allows small crumbs, seasoning particles (e.g., salt) and the like to drop below the lift and not be presented to the user.

Manner of Use of the Sixth Embodiment

The container apparatus 601 of the sixth embodiment (as depicted in FIGS. 21-23) is typically used by. Installing the parts into the assemblies described herein with respect to FIGS. 21-23. A cap or lid (not shown, but as per lid 452 of FIG. 19) can be employed with the apparatus 601 generally in the manner described herein with respect to the other exemplary embodiments. A user of the apparatus 601 can unseal the container by removing such cap or lid. The user can manipulate the apparatus 601 to rotate the inner part 631 relative to the container 651. Such rotation of the inner part 631 relative to the outer container 651 will cause the followers 681 to be forced upwardly (or downwardly, depending on the relative direction of rotating movement, and the slope or shape of the cam features 690, 692, 694).

Operating the apparatus 601 by turning the inner part 631 in the proper direction relative to the canister 651 with the assembly 601 in an upright orientation forces the lift 610 in an upward direction. This results in elevating the lift 610, and raising at least a portion of any contents stored within the inner liner 631 above any liquid bath 613. Elevation of the lift 610 can result in presenting the contents supported thereon to a user in a conveniently available position by raising at least the upper portion of the contents out of the liquid bath 613.

After the contents are lifted in the manner described above to facilitate removal of at least a portion of the contents supported on the lift 610, the apparatus 601 can then be manipulated so as to lower the contents toward a lower position to at least substantially place the contents back into the liquid bath 613. This can be accomplished, for example, by rotating the inner part 631 relative to the canister 651 in a direction opposite that required to move the lift 610 toward the upper position, as described herein above.

According to the sixth embodiment, the manners of use and methods performed thereby include selecting an assembly having the features described and/or depicted herein with respect to the sixth embodiment. The manners of use further can include one or more methods or actions shown and/or described herein with respect to the other exemplary embodiments.

Specific exemplary embodiments associated with the sixth embodiment can include one or more of the following actions. An apparatus such as the apparatus 601 can be selected to have a canister (e.g., 651) with an opening and a substantially liquid proof interior compartment, as well as a lift operator (e.g., 631) substantially within the compartment, and a removable closure (e.g., lid 452 of FIG. 19) that can be used to open or reseal the canister. The canister 651 can be packed with a liquid bath (e.g., 613, FIG. 23) and at least one article within the liquid bath. The closure (e.g., lid 452 of FIG. 19) can be removed so that the lift 610 can be operated to move at least a portion of an article supported by the lift above the liquid bath (613) and toward the opening. At least a portion of the article (supported by the lift 610) can then be removed from the canister 651. The canister 651 can be resealed by installing the closure (e.g., 452, FIG. 19) over the opening.

In accordance with at least one embodiment of the present disclosure, the contents of the canister (e.g., 651) can be a foodstuff held in a liquid bath (e.g., 613, FIG. 23), which can be a liquid bath for the purpose of substantially preserving one or more characteristics of the foodstuff. In accordance with at least one embodiment of the present disclosure, the lift 610 is configured to facilitate drainage of the liquid bath therethrough.

More about Preferred Manners of Making the Sixth Embodiment

Other methods according to the present disclosure can include constructing or making or providing an apparatus in accordance with the sixth embodiment. The outer container (or canister) 651, the inner part (inner liner, or operator) 631, the lift 610, as well as other components, can be made from a suitable liquid-proof material. For example, the canister 651, as well as other components, can be made from ceramic, metal, glass, plastic, or poly material, as well as other materials coated or lined with a liquid impermeable barrier or liner. The canister 651 can be fabricated in a manner to resist leakage of liquid contents. For example, the canister 651 can be fabricated according to a process so as to produce a substantially unitary, or one-piece liquid-bearing container.

The canister 651, and the inner part 631, can be configured and/or made from a material suitable to allow the contents of the container to be viewed from outside the container. For example, the canister 651 and the inner part 631 can be fabricated from a substantially transparent material such as various plastics and glass, or other suitable materials now known or hereafter developed. A transparent canister 651 and/or inner part 631 can be particularly advantageous for use in apparatus 601 marketed or otherwise used as storage devices for one or more various types of foodstuffs since this will allow the foodstuff contents of the container 601 to be viewed by a user.

As an alternative to fabricating the inner part 631 from a transparent material, the inner part can be configured to have little or no sidewalls. For example, the inner part 631 can be fabricated substantially from lengths of metal rod or other materials or provided with openings to reduce materials. Alternatively, the inner part 631 can be fabricated so as to be substantially open to facilitate viewing of the contents of the container 601.

The container features (or canister engagement features) 690, 692, 694 can be made using any of a number of various means. The container features 690, 692, 694 can be made as part of the container forming process. For example, the container features 690, 692, 694 can be molded into the container 651 when the container is formed by a molding process. Alternatively, the container features 690, 692, 694 can be made after the canister 651 is formed. For example, the container features 690, 692, 694 can be formed by routing after the canister 651 is formed, or can be applied onto the canister 651 after the canister is formed.

Seventh Embodiment

Figure 24:
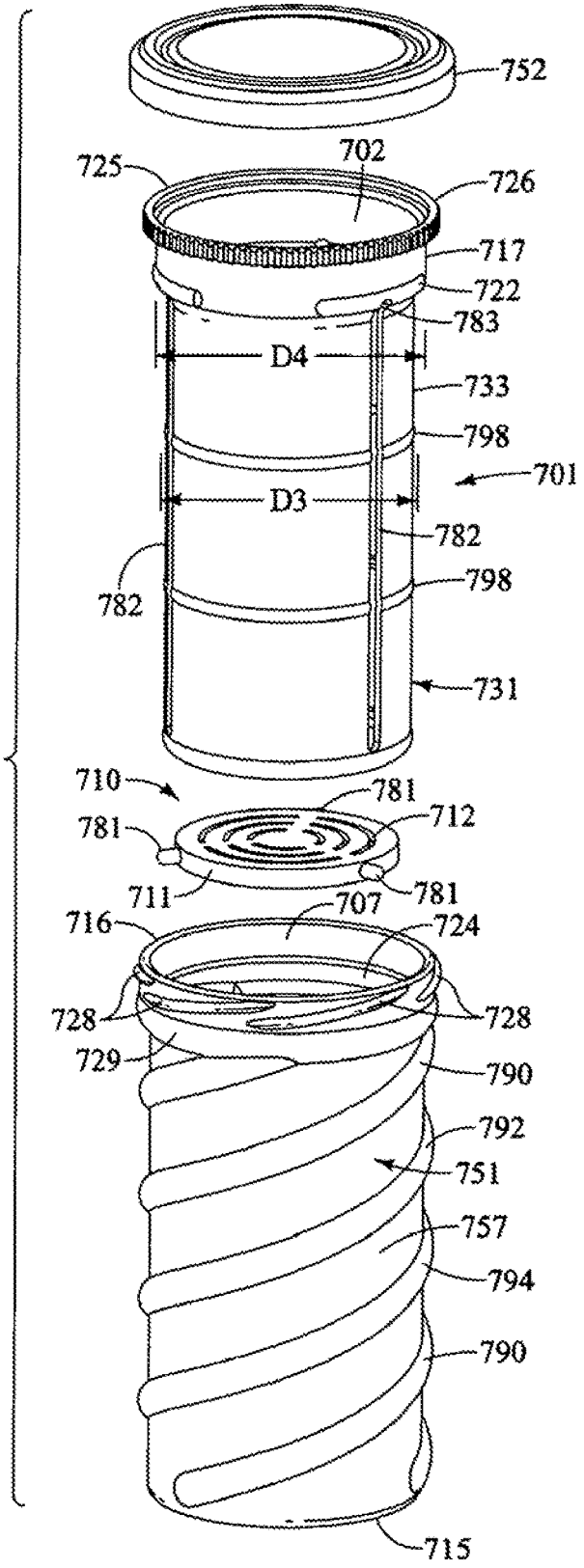
FIG. 24 is a partial isometric exploded view of a seventh embodiment of a container in accordance with the present disclosure.
Figure 25:
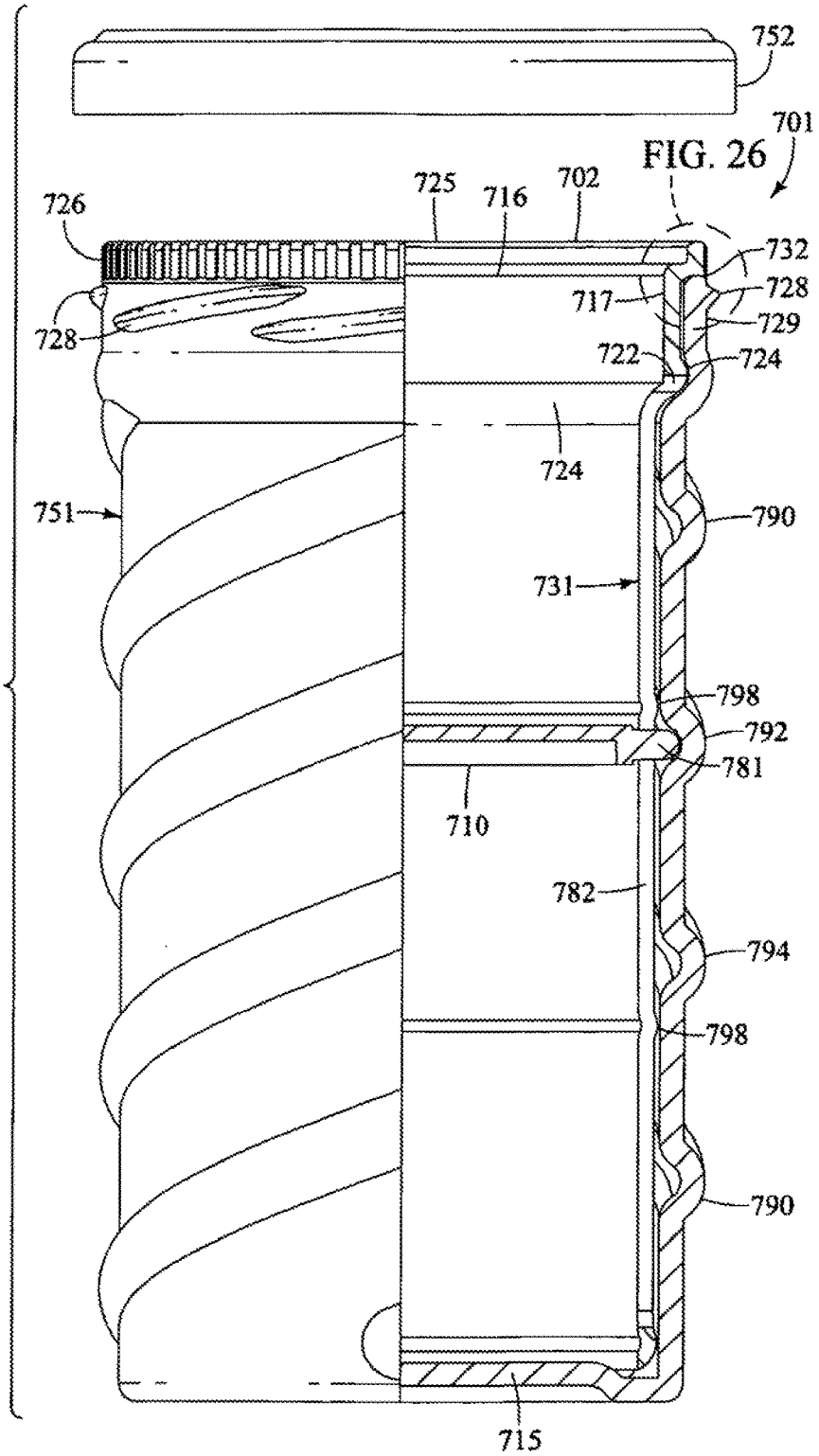
FIG. 25 is a partial side sectional view of the assembled container of the seventh embodiment depicted in FIG. 24.

Turning now to FIG. 24, an exploded view of a container 701 in accordance with the present disclosure is depicted in a partial isometric side view. FIG. 25 is a partial sectional view of the container 701 in an assembled form. FIGS. 24 and 25 will be described together. As an initial item, it will be appreciated that the assembled container 701 of FIG. 25 differs from the container 601 of FIG. 21 in at least one significant manner. Specifically, in the container 601 the inner liner/actuator 631 (FIG. 22) fits entirely within the outer sleeve (or canister) 651. Thus, in order to actuate the lift 612, the user must place one or more fingers inside the container 601 to contact one or more of the top features 699 to cause the operator 631 to rotate within the outer sleeve 651. This can be disadvantageous since it increases the opportunity for foreign matter to be introduced into the container 601 by the user's fingers, and also makes it easier for the user's fingers to become soiled or contaminated by contents within the container 601. By contrast, the container 701 of FIG. 25 includes an operator 731 having an upper gripping ring 726 which protrudes above the top edge of the outer sleeve or canister 751. The gripping ring 726 can be provided with gripping features (such as the gripping serrations depicted in FIG. 24) to aid the user in gripping the ring. In this way the user can grasp the gripping ring 726 of the operator 731 to cause the operator to rotate without having to insert one or more fingers into the container 701.

Figure 25A:
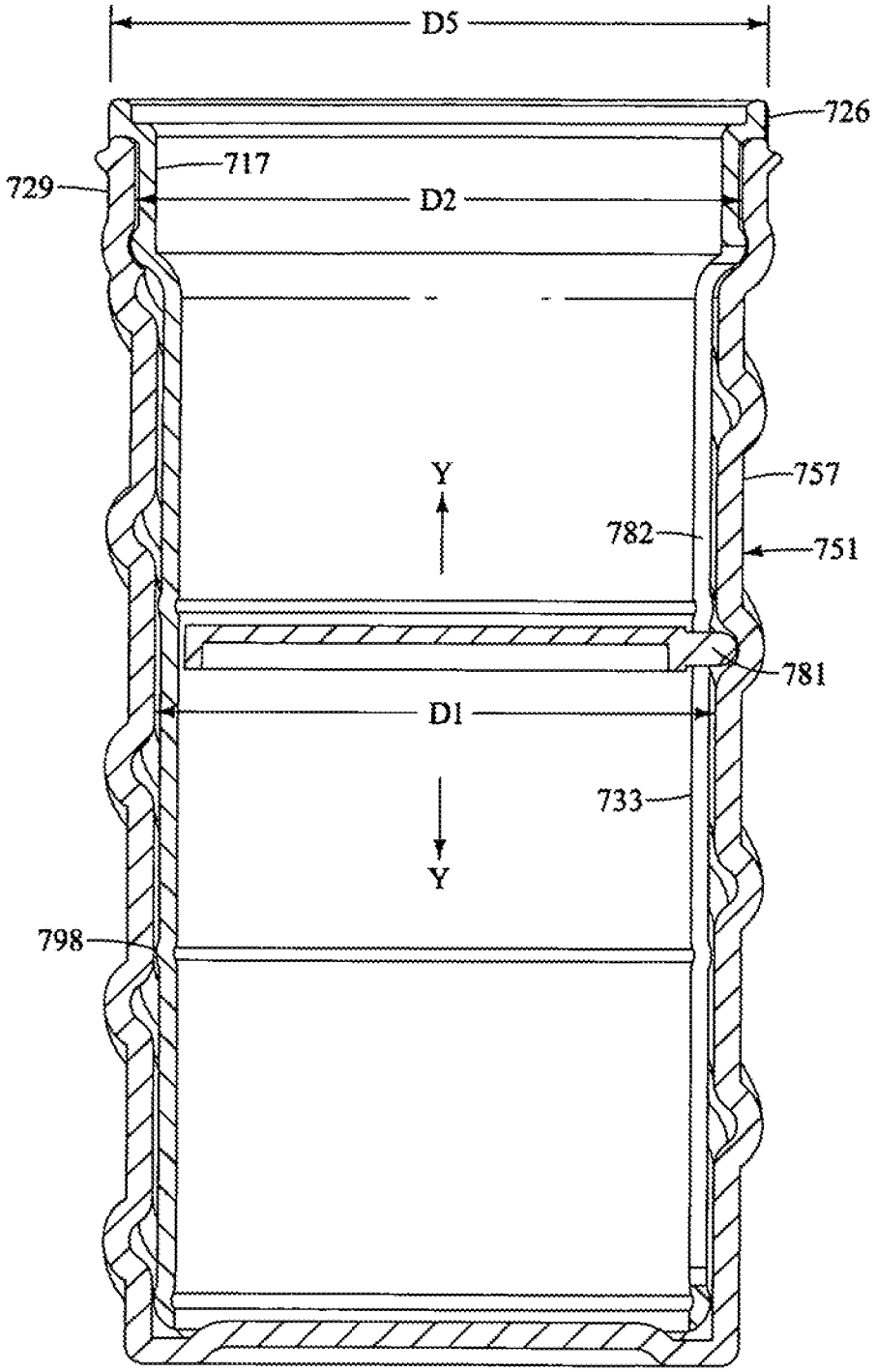
FIG. 25A is a full side sectional view of the assembled container of the seventh embodiment depicted in FIGS. 24 and 25.

The container 701, as depicted in FIG. 24, includes the following components: (i) an outer container (or canister) 751; an inner part (or operator) 731; and a lift 710. A lid or cap 752 can also be optionally provided to close the container 701. The canister 751, inner part (or operator) 731 and lift 710 generally fit together and operate as described above with the sixth embodiment of FIGS. 21 through 23. A cross section side view of the assembled container 701 is depicted in FIG. 25A. The various components of the container 701 depicted in FIG. 24 will now be described.

Canister:

The canister 751 (FIGS. 24, 25 and 25A) includes a main body portion 757 which is preferably cylindrical in shape and is defined by a canister main body portion inside diameter D1 (FIG. 25A). The canister 751 includes a canister bottom 715 at a first end of the canister main body portion 757, and a canister upper flange portion 729 at a second end of the canister main body portion. The canister upper flange portion 729 is defined by a canister upper flange portion inside diameter D2 (FIG. 25A), which is also the canister main opening diameter. The canister main body portion 757 includes one or more container (or canister) engagement features 790, 792, 794. Preferably, the canister 751 includes at least two container engagement features (e.g., 790 and 792) to reduce tipping of the lift (710) within the operator 731 (described below). More preferably, the canister 751 includes at least three container engagement features (e.g., 790, 792 and 794) to further reduce tipping of the lift (710) within the operator 731. As described above with respect to container 601, container engagement features 790, 792, 794 (or container 701) can comprise essentially parallel helical grooves formed in the canister 751, and which protrude outward of the outer surface of the canister main body portion 757. The container engagement features 790, 792, 794 receive the lift projections (lift lugs) 781 of the lift 710 (described below) to allow the lift to move upward and downward in the container 701. As described above with respect to FIG. 5, one or more of the container engagement features 790, 792, 794, and/or one or more of the operator engagement features 782 (describe below), can be provided with unidirectional angular serrations (such as the angular serrations 37 of FIG. 5) to assist in keeping the lift 710 from descending within the operator 731 after the lift has been previously elevated (if such is desired). The canister upper flange portion 729 terminates at a canister upper lip 716. The canister upper lip 716 defines a canister main opening 707. Defined within the canister upper flange portion 729 is a securing feature receiver 724. As described below, the securing feature receiver 724 receives a securing feature on the operator (or container inner part) 731 to retain the operator within the canister 751. As depicted, the securing feature receiver 724 comprises a groove formed outwardly of the canister upper flange portion 729. The canister upper flange portion 729 can also include one or more lid engagement features 728 which can be used to allow a lid to be secured to the top of the container 701. In the variation depicted in FIGS. 24, 25 and 25A the lid engagement features 728 comprise lid thread features to allowed a twist-on-twist-off lid to be fastened to the top of the container 701. Container closing and sealing means will be described further below.

Operator 731:

As indicated above, the operator 731 (FIGS. 24, 25 and 25A) can also be described as the inner part of the container 701. The operator 731 includes an operator main body portion 733. As depicted in FIGS. 24, 25 and 25A the operator main body portion 733 is cylindrical in shape. However, as will be described below, in certain variations the operator main body portion 733 can be in shapes other than cylindrical. In the variation depicted in FIGS. 24, 25 and 25A, the operator can be referred to as an inner sleeve since the operator main body portion 733 essentially fits into canister main body portion 757 much like an inner sleeve, i.e., with the outside surface of the operator main body portion 733 being located adjacent the inner surface of the canister main body portion 757. The operator main body portion 733 can include spacing features 798 formed on the outside of the operator main body portion. As described above, the spacing features 798 serve to provide a slight space between the outer surface of the operator 731 and the inner surface of the canister 751. Providing space between the outer surface of the operator 731 and the inner surface of the canister 751 reduces frictional forces between the two surfaces, allowing the operator to turn or rotate more easily within the canister 751. As depicted in FIG. 24, the operator 730 includes four spacing features 798 which are essentially parallel raised rings. The spacing features 798 can be other shapes such a longitudinal ribs, helical rings, or any raised projection formed on the outside of the operator 731. Less preferably, the spacing features 798 can be formed on the inside wall of the canister 751. The operator main body portion 733 is defined by an operator outside diameter D3 (FIG. 24). When spacing features (798) are provided on the outer surface of the operator 731, then the operator outside diameter D3 is measured at the outer edges of the spacing features. The operator outside diameter D3 is selected to allow the operator 731 to be received within the canister 751 and allow rotation of the operator within the canister. The operator main body portion outside diameter D3 is substantially equal (or similar) to the canister main body portion inside diameter D1, i.e., the two diameters preferably differ from another one by less than about 5 percent of either diameter. In a first variation the operator outside diameter D3 is selected to be essentially the same as the canister main body portion inside diameter D1 (FIG. 25A). This first variation allows for a slight drag to be imposed between the spacing features 798 and the inside surface of the canister 751. In a second variation the operator outside diameter D3 is selected to be smaller than the canister main body portion inside diameter D1. This second variation allows for freer rotation of the operator 731 within the canister 751. In a third variation the operator outside diameter D3 is selected to be slightly larger than the canister main body portion inside diameter D1 so that the operator 731 is force-fit inside of the canister 751. This third variation allows for more drag to be applied between the spacing features 798 and the inside surface of the canister 751, and can be useful to ensure that the operator 731 does not autorotate due to the weight of contents within the container 701. Desirably the operator main body portion outside diameter D3 is between about 90 percent and 110 percent of the canister main body portion inside diameter D1. It is understood that an operator main body portion outside diameter D3 which is greater than 100 percent of the canister main body portion inside diameter D1 presents a forced fit situation between the operator 731 and the canister 751. This forced fit situation can be accommodated by fabricating one of both of the canister 751 and the operator 731, or portions thereof, from a flexible material which allows sufficient deformation in the canister 751 and/or the operator 731 in order to allow the oversized canister main body portion 733 to be received within the canister 751.

The operator main body portion 733 includes operator engagement features 782, which can be similar to the inner part engagement features 682 described above with respect to container 601. As depicted in FIG. 24, the operator engagement features 782 comprise one or more slots which are oriented along the length of the operator main body portion 733. The slots 782 are formed through the sidewall of the operator main body portion 733 to allow the left projections 781 on the lift 710 to protrude through the slots 782 and engage the canister engagement features 790, 792, 794 (as will be described more fully below). Preferably the slots 782 terminate prior to the lower end of the operator 730 such that the lift 710 does not pass through the lower end of the operator. Similar to the discussion above with respect to canister engagement features 790, 792 and 794, preferably operator 731 includes two operator engagement features 782, and more preferably three operator engagement features. In general, there should be one operator engagement feature 782 for each canister engagement feature (790, etc.). The operator 731 further includes an operator upper flange portion 717. The operator upper flange portion 717 defines an operator upper lip 725 around the operator/container main opening 702 through which contents can be extracted from the container 701. The operator upper flange portion 717 is defined by an operator flange outside diameter D4 (FIG. 24). Operator flange outside diameter D4 is selected to allow a portion of the operator flange 717 to be received within the canister flange 729 and rotate therein. As such, the operator flange outside diameter D4 is preferably slightly smaller than the canister flange inside diameter D2 (FIG. 25A). In the variation depicted in FIGS. 24, 25 and 25A the operator upper flange portion 717 includes a gripping ring 726. The gripping ring 726 is defined by a gripping ring diameter D05 (FIG. 25A) which is larger than the canister flange inside diameter D2, such that the gripping ring 726 rides on the canister upper lip 716 (as depicted in FIGS. 25 and 25A). In the embodiment depicted in FIG. 24 the operator engagement features 782 include operator engagement feature extensions 783 which extend upwards into a portion of the operator upper flange portion 717. The useful function of operator engagement feature extensions 783 will be described below. The operator upper flange portion 717 can also include operator securing features 722. The securing features 722 are depicted as being protrusions above the outer surface of the operator flange 717. During assembly of the container 701, as the operator 731 is inserted into the canister 751, the securing features 722 will snap into the securing feature receiver 724 in the canister flange 729, thus securing the operator to the canister.

Lift 710:

The lift 710 (FIGS. 24, 25) can be the same as, or similar to, the lift 610 described above with respect to container 601. That is, the lift 710 includes a lift main body 711 and one of more lift projections 781 which extend from the outer edge of the lift body portion 711. As depicted in FIG. 24 the lift 710 includes three lift projections 781 in the shape of pins or lugs which are equally radially disposed about the outer periphery of the lift body 711. The use of three lift projections shown in FIG. 24 corresponds to the three canister engagement features (helixes 790, 792 and 794) in canister 751, and the three operator engagement features (slots 782) in the operator 731. In general, the number of lift projections 781 should correspond to the number of operator engagement features 782 and canister engagement features (790, 792 and 794). The length of the lift projections 781 beyond the outer edge of the lift body 711 is selected to allow the lift projections to pass through the operator engagement features (slots 782) and be received within the canister engagement features (helixes) 790, 792 and 794. The lift 710 can optionally include openings 712 to allow liquids and small particles (such as crumbs and the like) to pass through the lift body 711 and thus not be moved upward during upward movement of the lift.

Assembly of Container 701.

FIG. 24 depicts components of the container 701 in an exploded view, but does not depict an assembly drawing. Specifically, for assembly, the lift 710 is preferably inserted into the top opening 702 of the operator tube 731, with the lift projections 781 being guided into the operator engagement features (slots) 782. More specifically, the lift projections 781 can be initially inserted into the operator engagement feature extensions 783, which are of a larger diameter than the operator engagement features 782. The use of the operator engagement feature extensions 783 allows for the lift projections 710 to be easily inserted into the operator engagement features 782. The lift 710 can then drop down towards the lower end of the operator 731 (via lift projections 781 in operator engagement features 782), but the lift can be prevented from passing through the lower end of the operator by the closed ends (not numbered) of slots 782. The operator 731 (and including the lift 710) can then be inserted into the canister main opening 707 of the canister 751 with the lift projections 781 being guided into the canister engagement features (helixes 790, 792 and 794). The operator securing feature (or features) 722 on the operator 731 engage the securing feature receiver 724 in the canister flange 729, thus securing the operator 731 to the canister 751. At this point the operator 731, with the exception of the gripping ring 726, is disposed within the canister 751, and the gripping ring 726 extends outward of the canister (i.e., above the canister upper lip 716), thus forming the container 701 of FIGS. 25 and 25A. A lid or cap 752 (FIGS. 24, 25) can thereafter be applied to the upper open end 702 of the container 701.

While the canister 751 is preferably cylindrical in shape, the canister can also be polygonal in shape, provided that the polygonal shape is such that following assembly of the container 701 the lift projections 781 will still be able to engage one or more of the canister engagement features 790, 792, 794 as the operator 731 is rotated relative to the canister 750.

Operation of Container 701.

The container 701 of FIGS. 24, 25 and 25A can operate in a manner similar to that of container 601 (described above), with the primary difference being that for container 701, in order to rotate the operator 731 relative to the canister 751, the user can grasp the outer gripping ring 726, rather than placing his/her fingers inside of the container (601) to engage the top feature 699 (FIG. 22). Thus, when using container 701, a user can grasp the outer gripping ring 726 and cause the operator 731 to be rotated relative to the canister 751. Relative rotation of the operator 731 and canister 751 also causes relative rotation between the lift 710 and the canister 751. This relative rotation of the lift 710 and the canister 751 causes the lift projections 781 (on lift 710) to travel along the helical grooves (canister engagement features 790, 792, 794) formed on the canister. The helical shape of the grooves 790, 792, 794 about the canister 751 causes the lift 710 to move upward or downward (i.e., in vertical directions "Y", FIG. 25A) within the operator 731, depending on the relative direction of rotation the operator 731 and canister 751. At the same time, as the lift projections 781 are moving along the canister engagement features (helical grooves 790, 792, 794), the lift projections are caused to move upward or downward in the operator engagement features (slots 782). This arrangement can be appreciated by a study of FIG. 25, which depicts a lift projection 781 passing through operator engagement feature (or slot) 782, and being received within the canister engagement feature (helical groove) 792. As such, each lift projection 781 is located at an intersection of each respective operator engagement feature 782 and the corresponding canister engagement feature (790, 792 or 794). As described above, this configuration (of the container 701) is advantageous since the operator 731 and lift 710 remain rotationally static with respect to one another as the lift 710 traverses the length of the operator 731. The configuration reduces friction between contents within the operator 731 and the inner surface of the operator since the lift 710 will not tend to impart rotational forces to the contents during movement of the lift within the operator, unlike the configuration of container 1 (FIG. 1).

Figure 26:
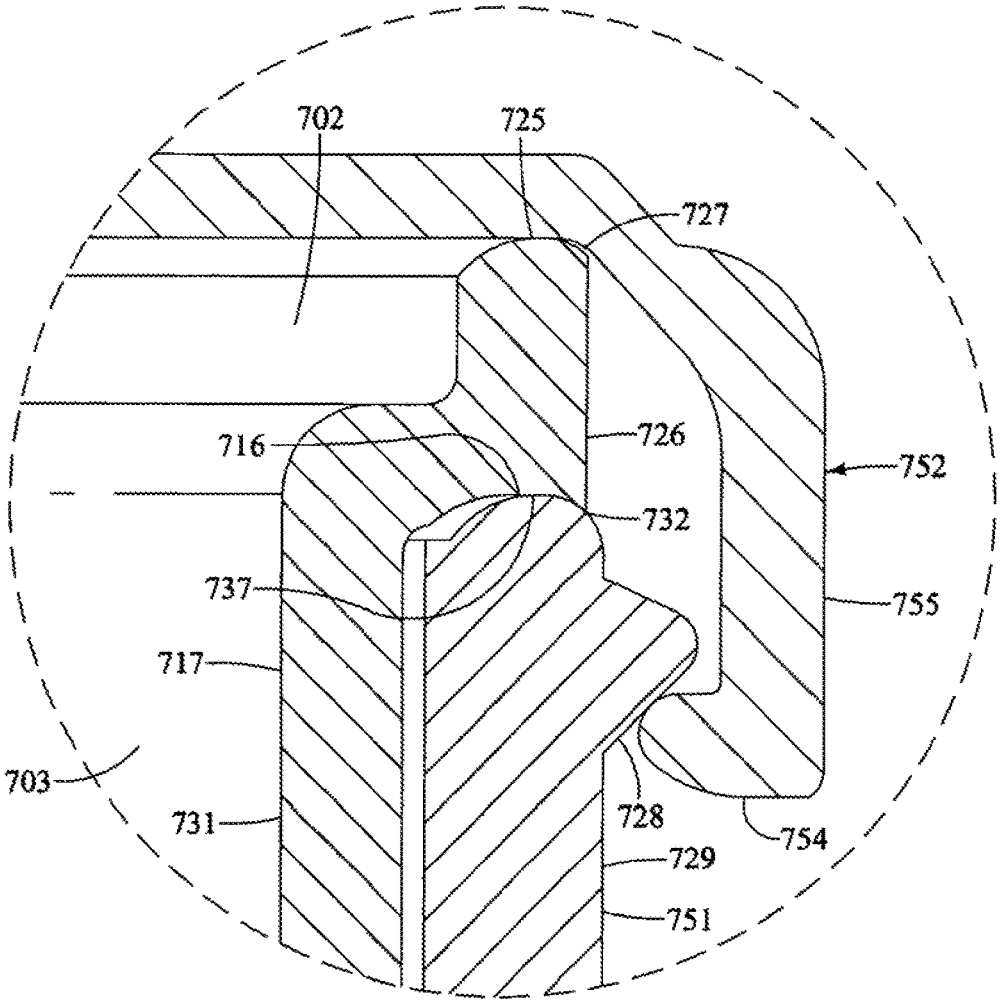
FIG. 26 is a an enlarged side sectional view of the upper right corner of the container of the seventh embodiment depicted in FIG. 25, depicting one sealing means for sealing the container.

Sealing Means for Container 701:

A close inspection of FIG. 25 shows that the configuration of the container 701 presents two locations at which fluids (liquids and/or gasses) can ingress or egress the container. The first location is the primary top opening 702 of the container 701, through which contents are intended to be extracted from the container. The second location for possible ingress or egress of fluids to or from the container 701 is at the junction 732 between a lower edge (or bottom surface) 737 of the gripping ring 726 of the operator 731, and the canister upper lip 716 (FIG. 24). This area is shown in an enlarged cross section detail in FIG. 26. The container main opening 702 presents the primary opening through which contends enter and are removed from the container 701. Main opening 702 can be sealed with a cap (such as cap 752), and/or with a pull-off safety seal 500 (FIGS. 19, 20). However, as seen in FIG. 26, the canister upper flange portion 729 terminates at the canister upper lip 716, and the lower surface of the 726 can rest against the canister upper lip at the junction 732. As indicated, this junction 732 presents a point at which fluids can further egress or ingress the main cavity 703 of the container 701. If the contents of the container 701 are to be hermetically sealed for freshness and/or preservation, or merely to prevent fluid leakage from the junction 732, then can be desirable to provide a means for sealing the container at junction 732. A number of alternative configurations that can be used to provide a seal at junction 732 will now be described.

Screw-on Cap Sealing Means:

A first means for sealing the container 701 at both the main opening 702 and at junction 732 is depicted in FIGS. 25 and 26. In the variation a screw-on (or twist-on-twist-off) cap 752 is provided. The screw-on cap 752 can be provided with engagement lugs 754 that are configured to engage cap screw threads 728 that are formed on the outer surface of the canister flange 729. In one example the configuration of the container threads 728 and lid lugs 754 can be provided according to standards promulgated by the Glass Packaging Institute ("GPI") of Alexandria, Va. (www.gri.org). In one specific example, a GPI standard size 82 top seal lug finish (for thread 728) in accordance with GPI DWG. NO. 20408 (available at http://www.gpi.org/industry-resources/finish-drawings) was used. The side flange 755 of the screw-cap 752 can be configured to non-standard dimensions to ensure that the side 755 of the cap 752 will fit over the gripping ring 726 and extend sufficiently far down the container 701 to allow the cap lugs 754 to engage the container threads 728. When the cap 752 is twisted onto the container 701, the cap lugs 754 will exert the following compressive forces which will tend to seal the container 701: (i) a first compressive force applied by the inside of the cap 752 around the upper lip 725 of the operator 731; and (ii) a second compressive force applied at the junction 732 between the operator 731 and the canister 751. Depending on the level (degree) of sealing desired, and the materials of construction used for the operator 731 and the canister 751, these two compressive forces alone can be sufficient to provide the desired sealing to the container 701. However, if the materials of construction used for the operator 731 and the canister 751 do not allow for a sufficient seal to be achieved by these compressive forces alone, then additional sealing means can be provided. For example, if the operator 731 and the canister 751 are fabricated from polyethylene terephthalate plastic (commonly referred to as "PET"), and if a hermetic seal is required for the container 701, then the compressive forces applied by the cap 752 may be insufficient to generate the hermetic seal. One specific additional sealing means that can be used is a sealing compound applied at one or both openings (i.e., main opening 702 and junction 732). A common sealing compound used in the food industry to seal metal caps to glass jars is a latex sealing compound applied to the inside of the metal cap. The latex sealing compound is usually sprayed onto the inside of the cap in an aqueous form and then dried or cured. Thus, in the example depicted in FIG. 26, a sealing compound can be applied to one of more of the following areas: (i) at main opening 702 by application of the sealing compound to one or both of the underside of the cap 752, and/or around the operator upper lip 725; and (ii) at junction 732 by application of the sealing compound to one or both of the canister upper lip 716 and/or the underside 737 of the gripping ring 726. The sealing compound can be an elastomeric sealing compound (such as the latex sealing compound just described) which allows for repeated re-sealing, or a non-elastomeric sealing compound (such as a glue) which does not allow for re-sealing once the initial seal is broken. It will be appreciated that the main opening 702 can also be sealed by using a pull-off safety seal such as the pull-off safety seal 500 of FIG. 19. In one variation wherein the cap 752 includes a cap screw thread (not shown or numbered) instead of the cap lugs 754, and the cap screw thread circumscribes at least 360 degrees about a similarly continuous canister screw thread (alternated to the staggered canister screw threads 728 depicted in FIG. 24), then by applying a sealing compound to the cap screw thread a hermetic seal can be achieved for both the main opening 702 and the junction 732. This can be visualized with respect to FIG. 26 if the canister screw thread 28 extends circumferentially 360 degrees about the canister flange 729, and the cap lug 754 is replaced with a mating cap screw thread (similar in shape to canister thread 728) and is extended circumferentially 360 degrees about the screw-on cap 752.

Figure 27:
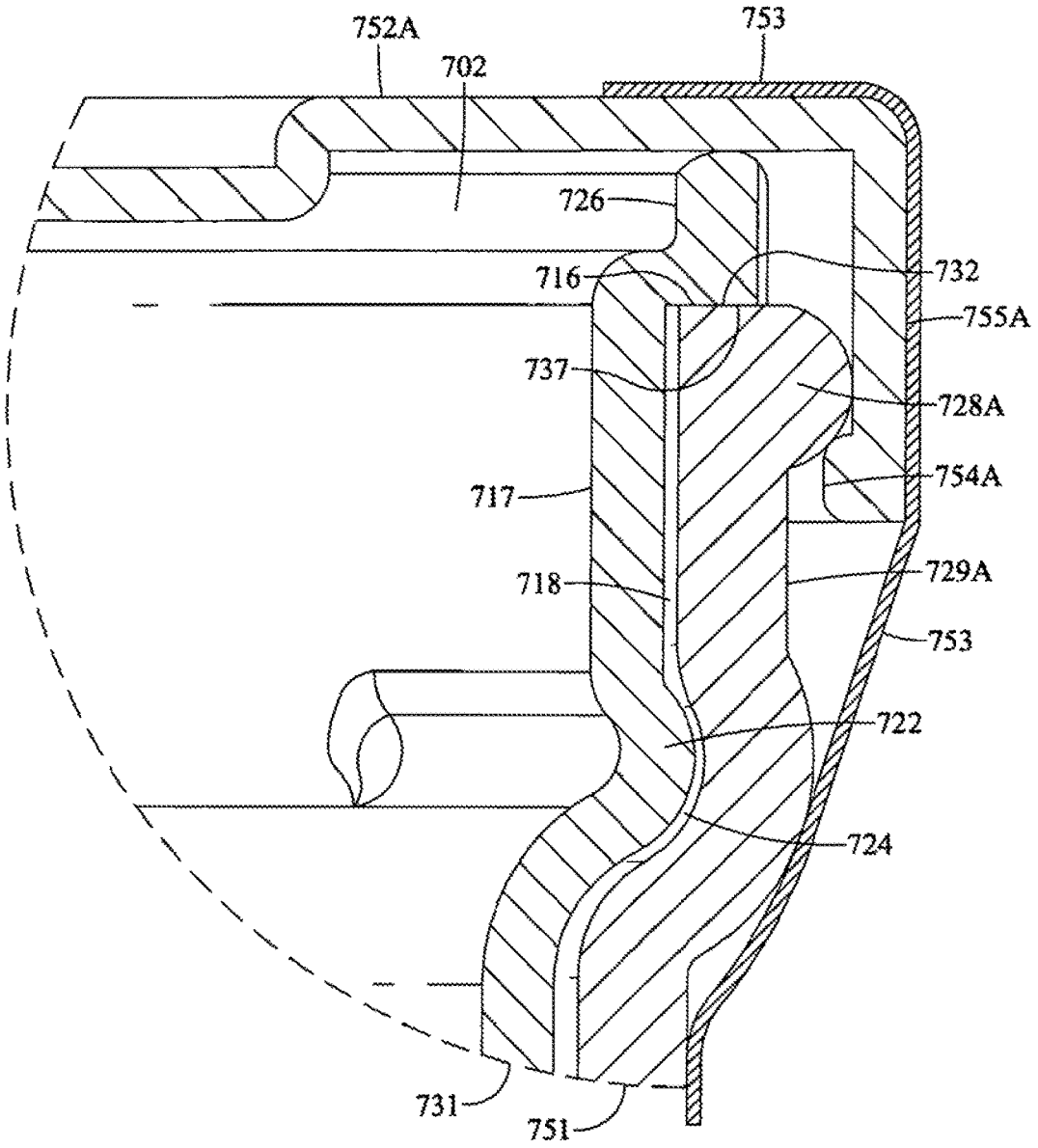
FIG. 27 is an enlarged side sectional view of an alternative configuration for the upper right corner of the container of the seventh embodiment depicted in FIG. 25, depicting another sealing means for sealing the container.

Snap-on Cap Sealing Means:

A second means for sealing the container 701 at both the main opening 702 and at the junction 732 is depicted in FIG. 27. FIG. 27 is an enlarged side sectional view of the same area of the container 701 as is shown in FIG. 26, but showing a different cap arrangement. In the variation depicted in FIG. 27 a snap-on (or snap-on-snap-off) cap 752A is provided. The snap-on cap 752A can be provided with a snap lug 754A which extends around the inside of the snap-on cap sidewall 755A. In the variation depicted in FIG. 27 the canister thread 728 of FIG. 26 is replaced with a cap securing feature 728A which extends at least partially around, and preferably entirely around, the outer surface of the canister flange 729A proximate the canister upper lip 716. Both the snap lug 754A and the cap securing feature 728A preferably extend circumferentially about the (respective) lid 752A and canister flange 729A. The cap side 755A is selected to be of a length that will ensure that the cap snap lug 754A cap will engage the cap securing feature 728A on the canister 751 when the cap 752A is placed over the main opening 702 of the container 701. In this way the cap 752A will cover both the main opening 702 and the junction 732. As with the screw-on cap described above, sealing compounds can also be employed with the snap-on cap 752A of FIG. 27 to improve sealing at main opening 702 and at junction 732. As depicted in FIG. 27, the container can additionally be provided with a shrink-wrap type safety seal 753 which can extend around the periphery of the cap 752A, and preferably over the canister flange 729A. (It will be appreciated that the shrink wrap seal of FIG. 27 can also be used with the screw-on cap variation of FIG. 26). Further, the container main opening 702 in FIG. 27 can also be sealed using a pull-off safety seal such as safety seal 500 of FIG. 19.

Other Sealing Means.

In addition to the means for sealing the container 701 described above, another means to achieve a seal to prevent ingress and/or egress of fluids at junction 732 (FIG. 27) is to apply a sealing compound in the area 718 between in inner surface of the canister flange 729A and the outer surface of the operator flange 717. In this variation the canister flange 729A can be provided with a slight outward taper (tapering outward towards the canister upper lip 716) such that when a cap (752, FIG. 26 or 752A, FIG. 27) is placed over the upper end of the canister flange 729A, the cap will tend to compress the inner walls of the canister flange 729A against the sealing compound placed between the flanges 717 and 729A. This arrangement can be used in combination with other sealing means described above (e.g., shrink-warp safety seal 753 and/or pull-off safety seal 500, FIG. 19).

Optional Features.

The containers described herein can be provided with one of more optional features which are not necessarily limited to use with any one or more of the containers described herein above. I will now describe these optional features.

Shaped Lift.

Figure 28:
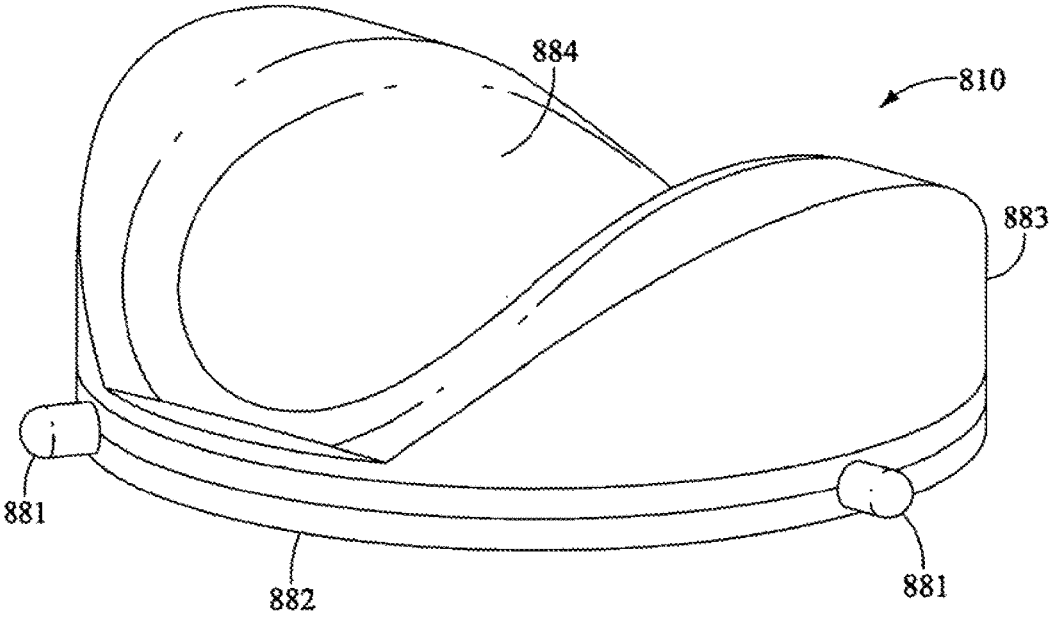
FIG. 28 is a partial isometric view of an alternative lift that can be used with containers provided for by the present disclosure, showing a contoured lift surface.

Turning now to FIG. 28, a shaped lift 810 that can be used with various containers (e.g., container 701 of FIGS. 24 and 25) is depicted in a partial isometric view. The shaped lift 810 includes a lift base 882 having a plurality of lift projections 881 spaced about the periphery of the lift base. Lift projections 881 can be essentially the same as lift projections 710 of FIG. 24. The shaped lift 810 further includes a lift body 883 which is supported on the lift base 882. (The lift base 882 and the lift body 883 can be fabricated as separate components which can then joined together by gluing or the like, or as a single component.) The lift body 883 is defined by a lift body upper surface 884 which is a contoured surface. In the example depicted in FIG. 28 the lift body upper surface 884 is contoured in a saddle shape. This can be useful for supporting contents in the container (e.g., container 701) that have a corresponding complementary shape. For example, if the contents of the container are saddle-shaped manufactured snack chips, then a stack of such chips can rest on the saddle-shaped lift surface 884. This provides the advantage of providing a larger support surface for the stack of chips. That is, if the lift upper surface 884 where a flat surface, then a stack of saddle-shaped snack chips will only be supported at the two ends of the lowermost chip in the stack, thus increasing the likelihood that the lowermost chip or chips will be damaged from weight applied by the stack of chips. While the lift surface 884 is depicted in FIG. 28 as being saddle-shaped (i.e., a surface having intersecting orthogonal concave and convex shapes), other shapes can also be provided, such as (and by way of example only): (i) a single concave surface; (ii) a single convex surface; (iii) a conical shaped surface (concave or convex); (iv) a hemispherical surface (concave or convex); (v) a dimpled surface (e.g., concave dimples to receive the ends of pretzel sticks or the like); (vi) a flat sloped surface; and (vii) any other three dimensional topological surface relative to the essentially flat horizontal orientation of the of the lift base 882.

Lift View Window.

Figure 29:
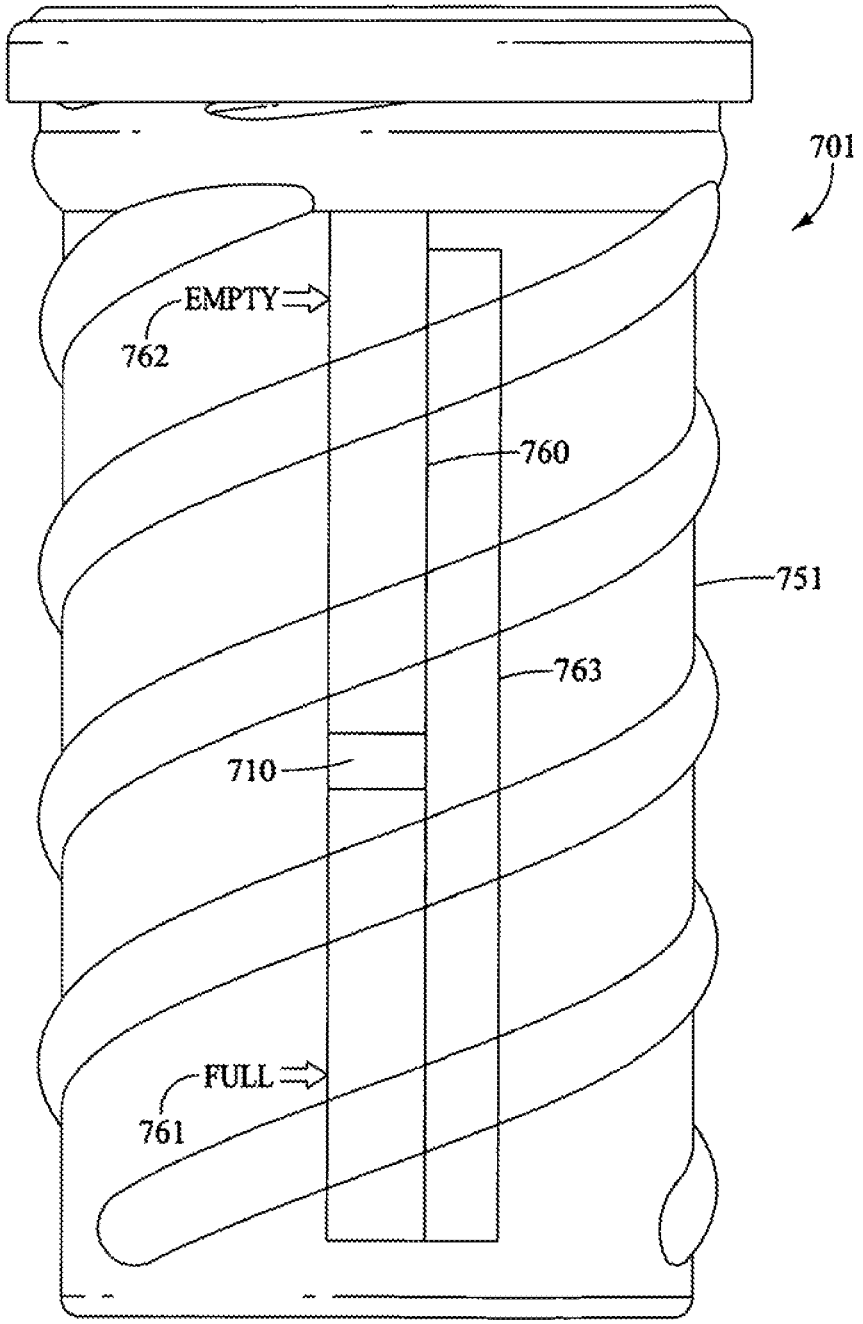
FIG. 29 is a side view of an alternative arrangement of a container as provided for by the present disclosure which includes a window to allow for viewing of the position of the lift in the container.

FIG. 29 is a side view of the container 701 of FIG. 25 and including an optional lift view window 760. The view window 760 can be used to allow a user to see the side of the lift 710 within the container 701, and thus approximate the amount of contents remaining in the container. The lift view window can also allow provide the user with a limited view of contents within the container 701. Specifically, to implement the view window 760 the operator 731 (FIG. 25) can be fabricated from a clear or transparent material, such as clear PET plastic. The canister 751 can be fabricated from a clear or transparent material, such as clear PET plastic. This will allow the lift 710 to be viewed through the canister 751 and operator 731. In one variation the canister 751 can be fabricated with a clear or transparent vertical strip corresponding to the window 760, and the rest of the canister can be translucent, opaque, or clear but colored. For example, current blow-molding techniques allow a plastic bottle to be blow molded with a clear vertical strip in the bottle. This is commonly seen in quart bottles of lubricants such as motor oil. In another variation a plastic shrink wrap label can be provided over the outside of the canister 751, the shrink wrap label having a clear or transparent vertical strip corresponding to the view window 760. Preferably the lift 710 is fabricated from a non-white opaque material so that the lift can be easily seen through the view window. For example, the lift 710 can be fabricated from red plastic. In addition to the view window, indicia can be applied to the outside of the canister to further inform the user of the status of contents within the container 701. For example, the word "FULL" (761) can be provided near the bottom of the view window 760 so that when the lift is located in that proximate area, the user will know that the container 701 is essentially full of contents. Further, the word "EMPTY" (762) can be provided near the top of the view window 760 so that when the lift is located in that proximate area, the user will know that the container 701 is nearly empty of contents. Other words can be used, such as "TIME TO BUY MORE" (instead of "EMPTY"). In a similar manner, a remaining-contents indicator strip 763 can be applied adjacent to the view window 760. In one example the remaining-contents indicator strip 763 can be a variable color strip, with a blue color towards the bottom of the strip, then moving upwards into green, yellow and then red along the length of the strip. Since the color red is often used as a cautionary color, when the lift is located proximate the red area of the remaining-contents strip 763 the user will tend to be made aware of the fact that the container 701 is nearly empty of contents. The indicia (words (761, 762), remaining-contents strip (763), and any other indicia (such as product marking of the like)) can be applied directly to the canister 751, or can be applied by a label applied to the canister (such as a shrink-wrap label).

Contents Retainer.

Figure 30:
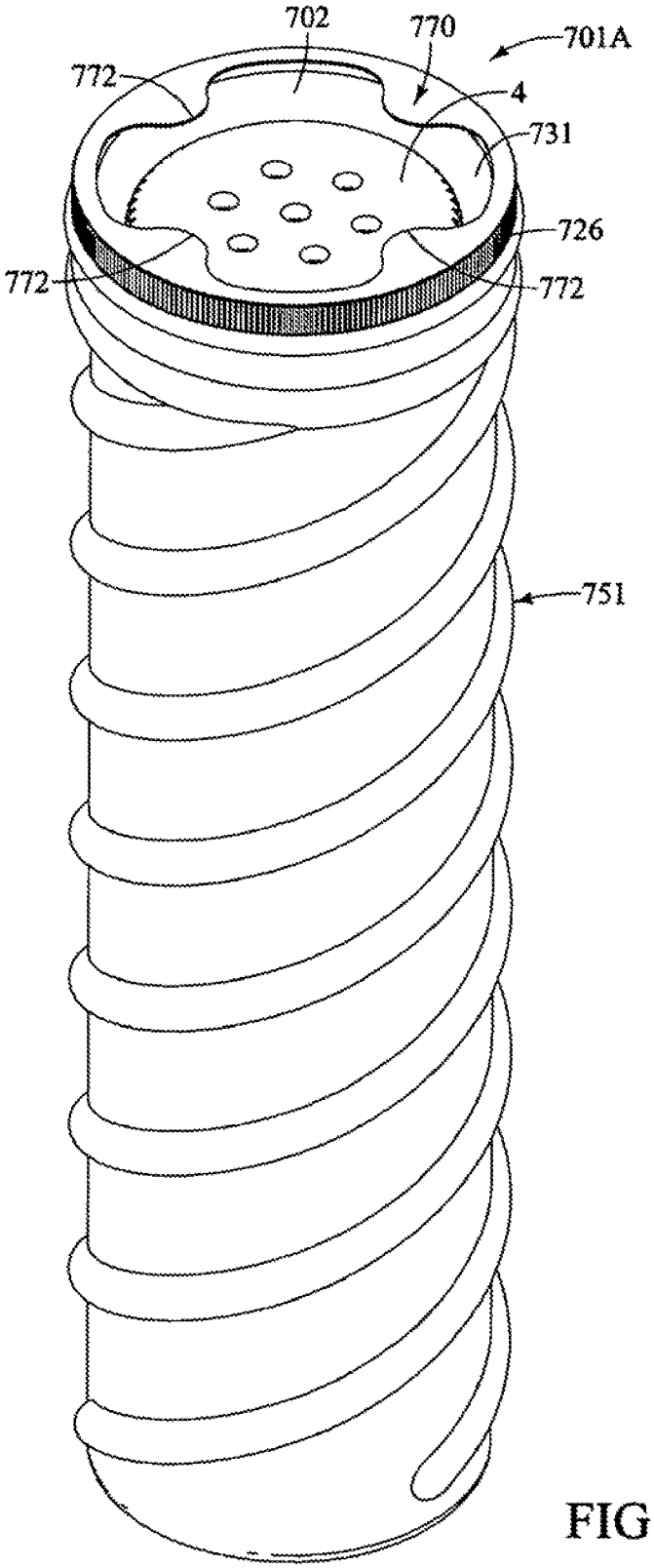
FIG. 30 is a partial isometric view of a container as provided for by the present disclosure which includes a contents retainer.

FIG. 30 is a partial isometric view of a container 701A (similar to container 701 of FIG. 25) which includes a contents retainer 770. The contents retainer 770 serves to restrain the contents (e.g., cracker 4) from inadvertently exiting the main opening 702 of the container 701A (as for example when the container is laid in a horizontal position). In the example shown the contents retainer 770 comprises a thin flat disc having a generally open center area (not numbered) which is applied to (or is part of) the top of the gripping ring 726. (As described above with respect to FIGS. 24 and 25, the gripping ring 726 can be a part of the operator 731.) The contents retainer 770 can be, for example, a separate part which can be glued or sonic welded or otherwise attached to the top of the gripping ring 726. The contents retainer 770 includes a plurality of flexible protrusions 772 which extend from the gripping ring 726 inwards to the container main opening 702. Thus, when the operator 731 is rotated relative to the canister 751, the contents 4 will be pushed past the flexible protrusions 772 and outward of the container main opening 702.

Multi-Lobed Operator.

Figure 31:
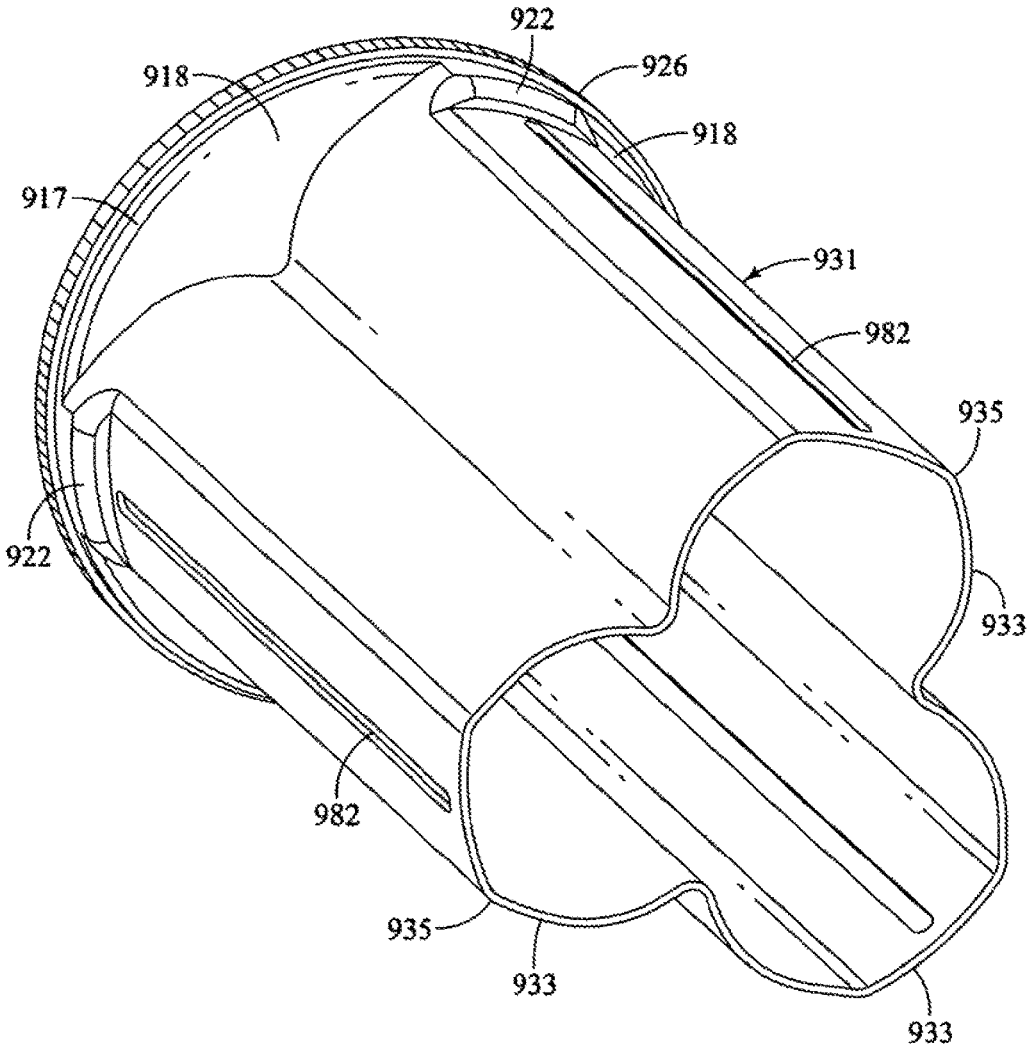
FIG. 31 is an oblique view of an alternative operator that can be used with containers provided for by the present disclosure, and which allows for multiple stacks of contents to be provided within a single container.
Figure 32:
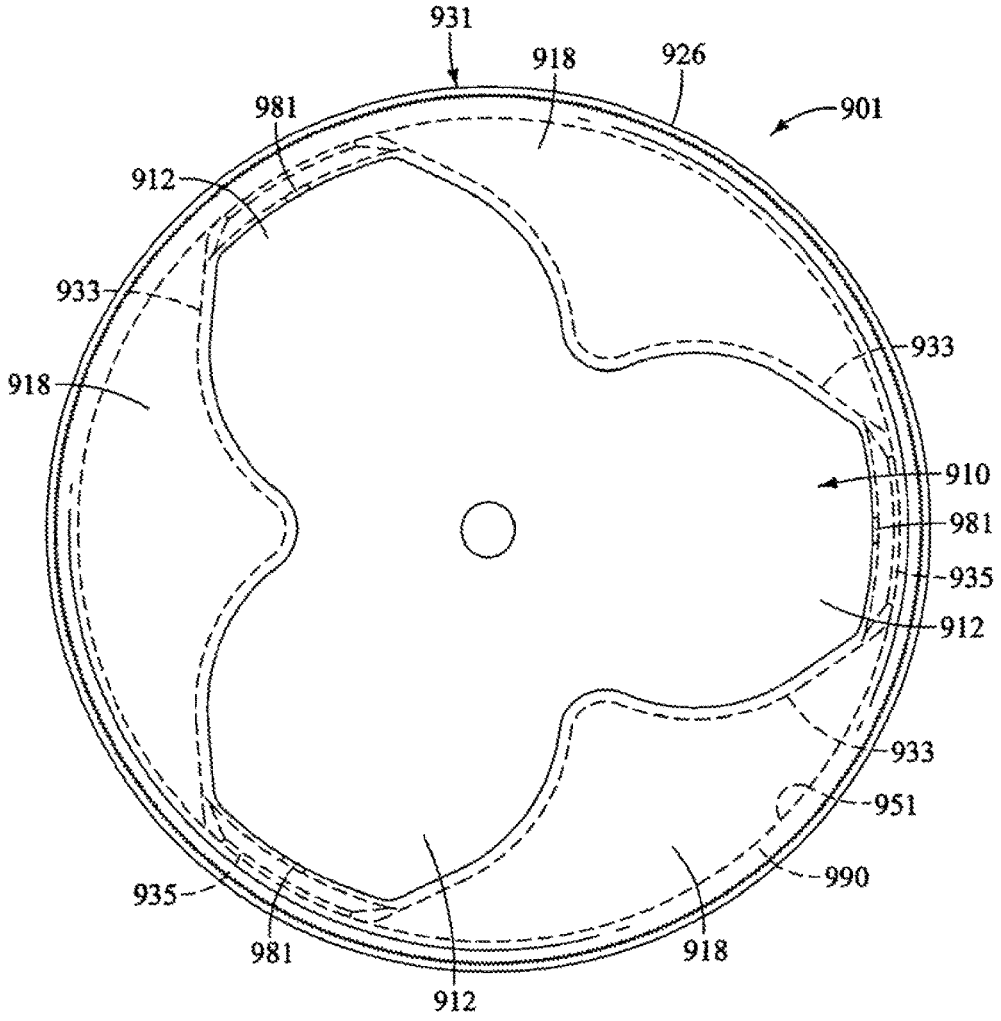
FIG. 32 is a plan view of a container which includes the alternative operator of FIG. 31.

FIG. 31 is an essentially oblique view of a multi-lobed operator 931 that can be used in a container according with the present disclosure. This view is generally looking up through an open bottom of the multi-lobed operator 931. The multi-lobed operator 931 includes three content lobes 933, each of which can be provided with contents. Multi-lobed operator 931 is particularly useful in conjunction with stacked snack foods such as chips, crackers, cookies, etc. The multi-lobed operator 931 thus allows more contents to be provided in a container without the need to increase the height of the container. This can be particularly advantageous when the containers are placed on a shelf in a retail location. Additionally, each lobe 933 of the multi-lobed operator 931 can be provided with different types of contents (e.g., if the contents are cookies, then a different flavor of cookie can be provided in each lobe; and if the contents are nuts, then a different type of nut can be provided in each lobe). The multi-lobed operator 931 includes one or more operator engagement features 982, which can function in a manner similar to the operator engagement features 782 described above with respect to FIGS. 24 and 25. That is, the operator engagement features 982 capture the lift projections on a lift (as will be described more fully below). The multi-lobed operator 931 includes an operator upper flange portion 917 which is topped by a gripping ring 926. The operator upper flange 917 can include securing features 922 which can operate similar to securing features 722 of operator 731—i.e., securing features engage with a corresponding securing feature receiver (such as securing feature receiver 724) in the canister (e.g., canister 751) to retain the operator 931 within the canister. The multi-lobed operator upper flange 917 also includes flange extension surfaces 918 which join the outer part of the flange 917 to the various operator lobes 933. While the multi-lobed operator 931 of FIG. 31 depicts three lobes 933, it will be appreciated that only two lobes can be used, and in such instance the two lobes are preferable diametrically opposed from one another. Further, more than three lobes 933 can also be provided. However, three lobes 933 (as depicted in FIG. 31) tend to maximize the use of the interior volume of the multi-lobed operator 931. Preferably, the lobes 933 (regardless of number used) are equally angularly spaced about the center of the operator 931. In general, each lobe 933 will have an outermost edge 935, and these outermost edges preferably will be tangent to a circle which circumscribes the lobes. The diameter of this circle which circumscribes the outermost edges of the lobes 933 defines an operator main body portion diameter similar to diameter D3 of FIG. 24. The lobes 933 can be circular or other shapes which basically result in the outermost edges 935 being in proximate tangential orientation to the inner surface of the canister (as depicted in FIG. 32, described below, showing canister 951). Further, the lobes 933 can be of different shapes and/or sizes to accommodate contents having different shapes. As will be appreciated from the discussion of FIG. 32 below, the lobes 933 are open to one another (and thus interconnected) in order to allow a common lift to be used for all of the lobes. A container 901 using the multi-lobed operator 931 is depicted in FIG. 32.

Container 901 which incorporates the multi-lobed operator 931 of FIG. 31 is depicted in FIG. 32 in a plan view—i.e., with the viewer looking down on the operator gripping ring 926 and the flange extension surfaces 918. The container 901 includes a canister 951 which can be the same as, or similar to, the canister 751 of FIGS. 24 and 25. The container 901 further includes lift 910 which fits within multi-lobed operator 931. As can be seen, the lift 910 includes three lift lobes 912 which are complementary with the three operator lobes 933. A lift projection 981 is provided at the outermost edge of each lift lobe 912, and the lift projections engage the operator engagement features 982 (FIG. 31). As can be seen in FIG. 32, the outer edges 935 of the lift lobes 933 of the multi-lobe lift 931 are in tangential arrangement with the inner surface of the canister 951 along a circular segment of the canister. Thus, as the multi-lobe operator 931 is rotated with respect to the canister 951, the lift 910 will also rotate (by virtue of lift projections 981 being engaged with operator engagement features 982 and canister engagement feature 960), causing the lift to move upwards (or downwards) within the container 901 (in the manner described above with respect to container 701 of FIGS. 24 and 25).

Lift Lock Unit.

Figure 33:
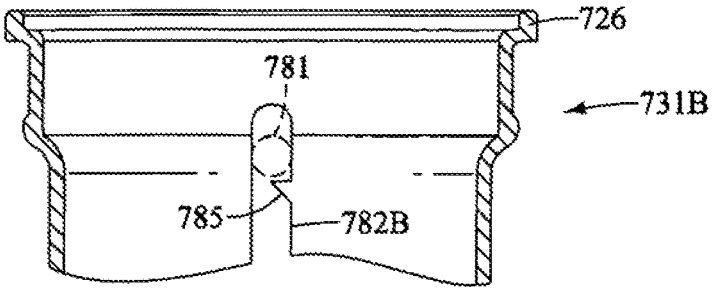
FIG. 33 is a partial side sectional view of a container operator provided for by the present disclosure, and including a lift lock.

In certain applications is can be desirable to fabricate the container (e.g., container 701, FIG. 24) so that the lift 710 cannot be lowered back into the operator 731 once the lift has reached the top of the container and the last of the contents have been removed. This can be accomplished in one of a number of ways, such as by providing a lift lock feature on the canister 751 or on the operator 731. FIG. 33 is an enlarged side detail of a canister 731B that is modified to provide a lift lock feature. The operator includes gripping ring 726 (as described above) and operator engagement feature 782B, which is a vertical slot formed in the operator 731B. Near the top of the operator engagement feature 782B is a unidirectional tooth 785 which allows the lift projection 781 (shown in phantom lines) to pass upward beyond the tooth 785 (as depicted), but does not allow the lift projection 781 to move back down in the operator engagement feature 782B. The operator 731B can be fabricated from a material such as PET plastic which provides sufficient flexibility in the tooth 785 to allow the lift projection 781 to move upwards past the tooth. Another means to restrict downward travel of the lift after the lift has reached a top-most position is to form the tops of canister engagement features (790, 792, 794, FIG. 24) with drop-offs which the lift projections 781 move into. These drop offs can be molded into the upper ends of the helical slots (790, 792, 794).

Candle Holding Embodiment.

Figure 34:
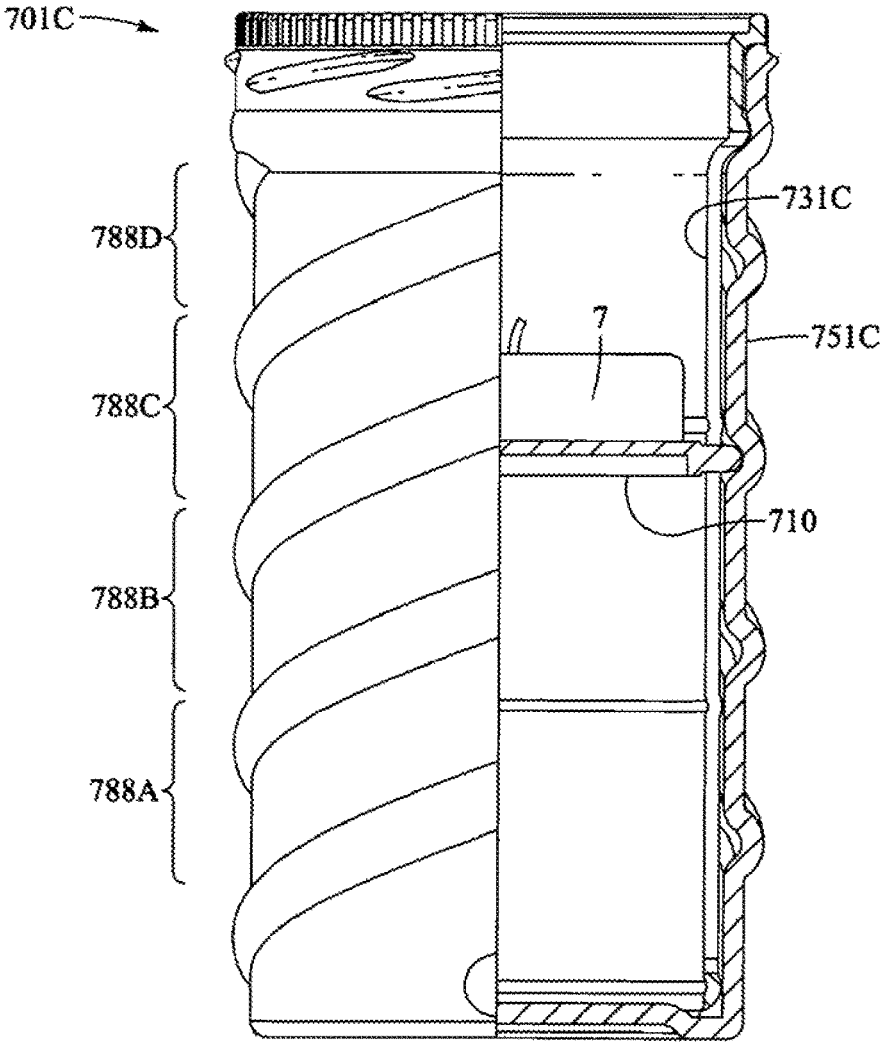
FIG. 34 is a partial side sectional view a container operator provided for by the present disclosure used to hold a candle.

In one embodiment a container of the present disclosure can be used to hold a candle. In particular, containers described herein can be used to hold a candle (such as a votive candle or tea candle, for example) so that the candle can be elevated on the lift for lighting, and then lowered into the container during burning. One example is depicted in FIG. 34, which is a side partial sectional view of a container 701C. (An exemplary use of the candle holding container 701C is on tables in restaurants.) Container 701C can be the same as, or similar to, container 701 of FIGS. 24 and 25, except as described below. When used to hold a candle, container 701C is preferably fabricated from materials which can withstand heat generated by the candle (7) without deforming the components of the container. For example, the canister 751C and/or the operator 731C can be fabricated from glass or heat-resistant plastic. Examples of heat resistant plastic that can be used include a polycarbonate plastic and a polyetherimide plastic. The canister 751C and the operator 731C are preferably made from a material that is transparent or translucent to allow light from the candle 7 to emanate from the sidewalls of the container 7010. While the candle 7 is depicted in FIG. 34 as being supported directly on the lift 710, the candle can also be contained in holder such (as a metal cup, common for tea candles, or in a glass votive) which can then be placed on the lift. The use of a holder for the candle 7 to contain the candle 7 on the lift 710 reduces the likelihood that the lift 710 might become bound against the canister 751C due to wax dripping from candle.

An optional feature that can be added to the candle holding container 701C of FIG. 34 are gradations (788A-788D) in one or both of the canister 751C and the operator 7310. In one example the gradations 788A-788D can be gradations in transparency. For example, zone 788A can be a nearly opaque zone, zone 788A can be an essentially transparent zone, and zones 788B and 788C can be respective zones of increasing transparency between zones 788A and 788D. One method for decreasing the transparency of the canister 751C and/or the operator 731C is by texturizing or roughening the inner or outer surface of the component (canister or operator) to cause more diffusion of light emanating from the candle 7. Another method for decreasing the transparency of the canister 7510 and/or the operator 731C is by etching (such as acid etching) one or both of the canister 751C and the operator 731C. Yet another method for decreasing the transparency of the canister 751C and/or the operator 731C is by applying a diffusing material (such as a spray on coating) to one or both of the canister 751C and the operator 731C. In yet another example the gradations 788A-7880 can be gradations in color. For example, zone 788A can be blue, zone 788B can be green, zone 788C can be red, and zone 788D can be yellow. It will also be appreciated that the zones 788A-788D do not need to be distinct zones, but can form a continuous transition in the selected gradations (i.e., in transparency and/or colors) over a desired range (e.g., from opaque to transparent).

In the candle holding embodiment, the candle can be replaced with another light source, such as a battery powered light.

Power-Driven Option.

In one variation a container in accordance with the present disclosures can be provided with a power-driven driver to drive the operator about the canister. The power-driven driver can be an electrically-driven power driver, such as an electric motor powered by batteries or A/C wall current. This variation can be applied to any of the various embodiments described above, but will now described with respect to the embodiment depicted in FIG. 25. (No drawing is provided to show this variation, but the following description is deemed sufficient to allow one of skill in the art to implement the disclosed variation.) In this variation a space is provided between the bottom 715 of the canister 751 and the bottom (not numbered) of the operator. This space can be used to house the driver (e.g., electric motor) and batteries, transformers, converters or other electrical on non-electrical components needed to provide electrical power (or other power) to the driver. The driver is preferably secured to the canister 751. A ring gear can be provided on the bottom of the operator 731, and a pinion gear can be attached to the driver, with the pinion gear engaging the ring gear. Energizing the driver will cause the pinion gear to rotate the ring gear, and thus the operator 731, thereby moving the operator about the canister 751 and thus advancing the lift 710 within the operator. The driver can be provided with a reversing switch to enable a user to reverse direction of rotation of the operator 731 about the canister 751.

Eighth Embodiment

Figure 35:
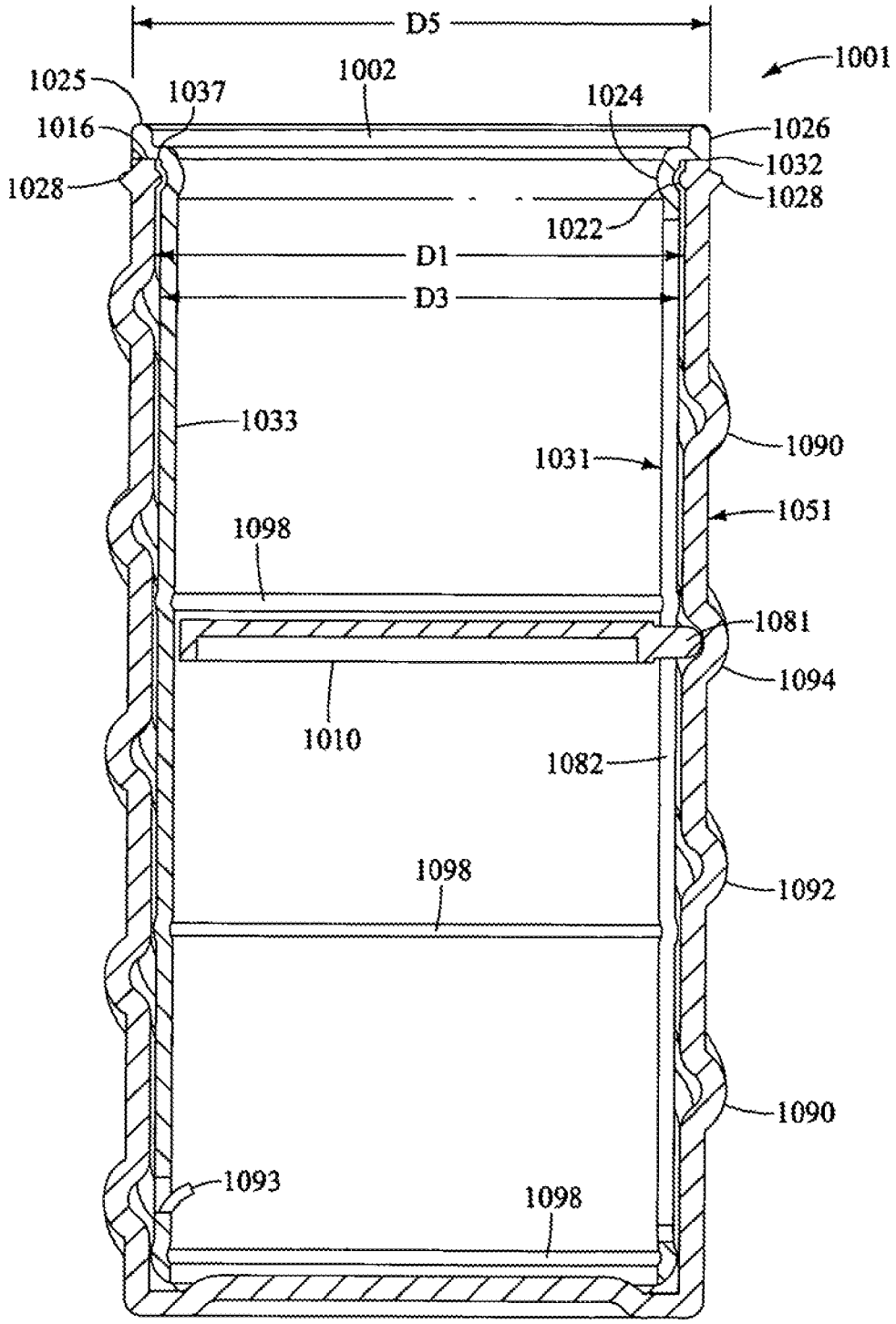
FIG. 35 is a side sectional view of a container according to an eighth embodiment in accordance with the present disclosure.

Turning now to FIG. 35, an eighth embodiment of a container 1001 in accordance with the present disclosure is depicted in a side sectional view. Container 1001 includes a canister 1051, an operator 1031, and a lift 1010, which all cooperate operationally with one another in the manner described above with respect to canister 751, operator 731, and lift 710 of container 701 (FIGS. 24 and 25). That is, the operation of container 1001 can be similar in manner of operation to the container 701 of FIGS. 24 and 25. However, the container 1001 of FIG. 35 differs in construction and design from the container 701 of FIGS. 24 and 25 at least in the following ways: (i) the canister 1051 of container 1001 does not include a canister upper flange portion (such as canister upper flange portion 729 of container 701); and (ii) the operator 1031 of container 1001 does not include an operator upper flange portion (such as operator upper flange portion 717 of container 701). As was described above, one advantage to providing for an operator upper flange portion (717, FIG. 24) is that this design allows for the provision of operator engagement feature extensions 783, which can be used to receive the lift extensions (781, FIG. 24) during assembly of the container (701). As can be appreciated from FIG. 35, during assembly of container 1001 the lift 1010, and specifically the lift extensions 1081, cannot easily be inserted into the operator engagement features 1082 through the main opening 1002 in the operator 1031 if the lift extensions are essentially rigid. Thus, in order to allow the lift 1010 to be inserted into the operator 1031 during assembly of the container 1001, at least two different configurations can be provided. In a first configuration the lift extensions 1081 can be fabricated from a flexible material (such as a rubber compound or a flexible plastic) such that the lift extensions can flex while the lift 1010 is being inserted through the main opening 1002. In a second configuration the operator 1031, and the operator engagement features (slots 1082) can be open at the bottom of the operator 1031, and the operator can be provided with unidirectional flexible lift securing tabs 1093 (or similar lift securing means). In this second configuration the lift 1010 (and specifically, the lift extensions 1081) can be inserted into an open bottom of the operator 1031 and the lift then held inside the operator 1031 once the lift extensions 1081 have passed over the unidirectional flexible lift securing tabs 1093.

With further respect to FIG. 35, the canister 1051 of container 1001 includes canister engagement features (helical grooves) 1090, 1092 and 1094, which can be the same as, or similar to, canister engagement features (helical grooves) 790, 792 and 794 of canister 751 of FIG. 24. Canister 1051 is defined by a canister inside diameter D1, and includes a canister upper lip 1016. The container 1001 further includes the operator 1031, and the lift 1010. The operator 1031 can include an operator main body portion 1033, which is defined by an operator outside diameter D3. The operator 1031 can further include spacing features 1098 which can be similar to spacing features 798 described above with respect to container 701 of FIG. 24. When spacing features 1098 are provided on the operator 1031, the operator outside diameter D3 is preferably measured between the outside diameter of the spacing features 1098. The relationship of canister inside diameter D1 and operator outside diameter D3 can be as described above with respect to the same dimensions of container 701 of FIGS. 24, 25 and 25A. The operator 1031 (FIG. 35) further includes a gripping ring 1026. The gripping ring 1026 defines an operator upper lip 1025, and is also defined by a gripping ring lower (or bottom) edge 1037 and a gripping ring outside diameter D5. Gripping ring outside diameter D5 is greater than canister inside diameter D1 (to thus retain the gripping ring 1026 outside of canister 1051). The canister 751 can be provided with securing feature 1022, and the operator 1031 can be provided with securing feature receiver 1024 configured to receive securing feature 1022. One or both of securing feature 1022 (of canister 1051) and securing feature receiver 1024 (of operator 1031) can be formed in the respective canister 1051 or operator 1031 from a flexible material in order to allow the securing feature 1022 to form a snap-fit with the securing feature receiver 1024 and thus secure the operator 1031 within the canister 1051 during assembly of the container 1001. It will be appreciated that the positions of the securing feature 1022 and the securing feature receiver 1024 are reversed from the arrangement depicted in the embodiment depicted in FIG. 24 (wherein the securing feature 722 is formed in the operator 731, and the securing feature receiver 724 is formed in the canister 751). Thus, the securing features 722, 1022 can be formed in either the canister (751, 1051) or the operator (731, 1031), with the securing feature receiver 724, 1024 formed in the other part (i.e., operator or canister, respectively).

Canister 1051 of FIG. 35 can be provided with a lid sealing thread feature 1028 to allow a cap (e.g., cap 752 of FIG. 26) to be applied to the container 1001 (in a manner similar to that described above with respect to FIG. 26). The junction 1032 (FIG. 35) between the canister upper lip 1016 and the lower edge 1037 of the gripping ring 1026 can be sealed in manners described above with respect to FIGS. 26 and 27.

Ninth Embodiment

Figure 36:
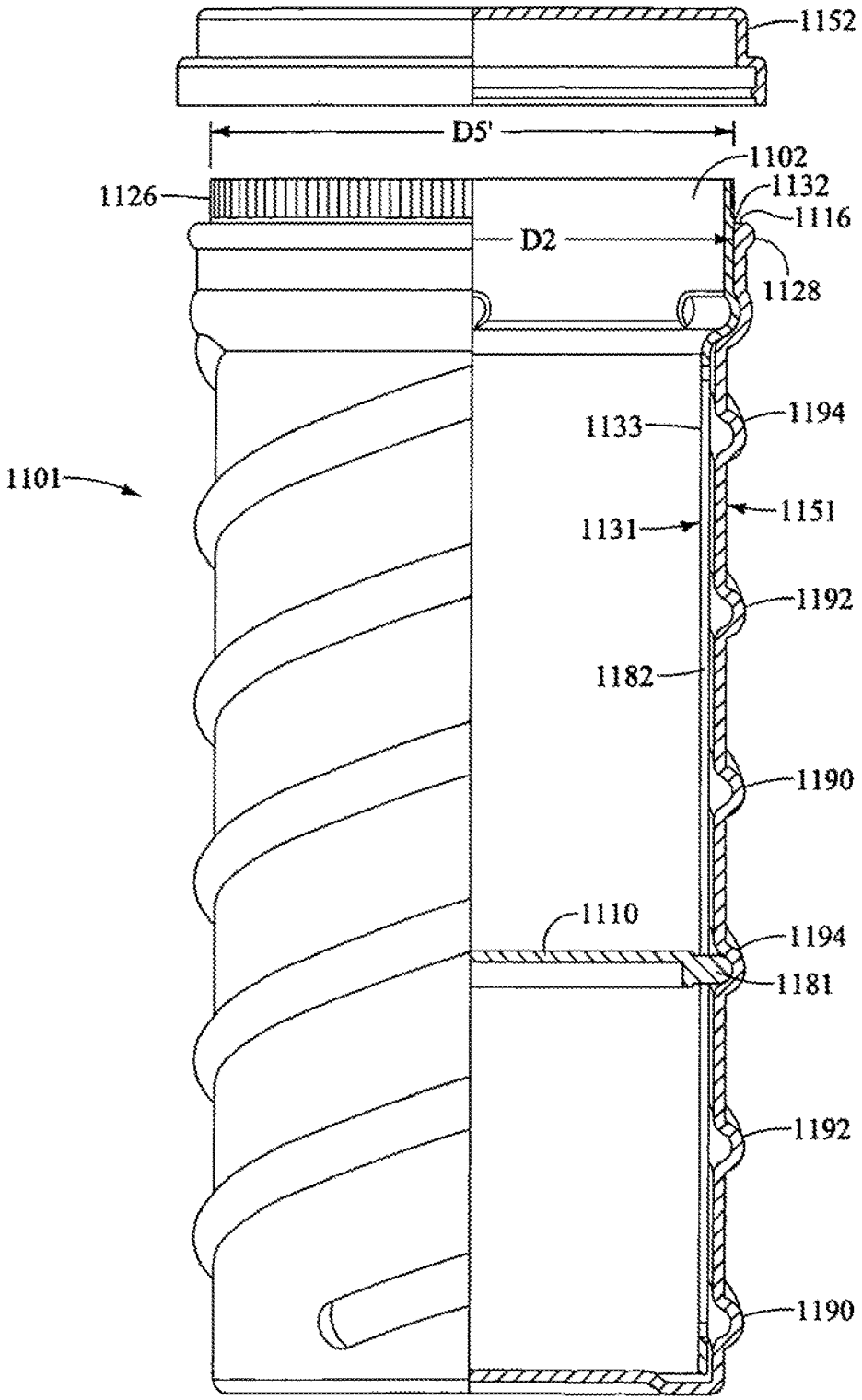
FIG. 36 is a partial side sectional view of a container according to a ninth embodiment in accordance with the present disclosure.

Turning now to FIG. 36, a ninth embodiment of a container 1101 in accordance with the present disclosure is depicted in a partial side sectional view. Container 1101 includes a canister 1151, an operator 1131, and a lift 1110, which all cooperate operationally with one another in the manner described above with respect to canister 751, operator 731, and lift 710 of container 701 (FIGS. 24 and 25). That is, the operation of container 1101 can be similar in manner of operation to the container 701 of FIGS. 24 and 25. However, the container 1101 of FIG. 38 differs in construction and design from the container 701 of FIGS. 24 and 25 at least in the following way: in FIG. 36 the outside diameter D5' of the gripping ring 1126 is essentially equal to the inside diameter D2 of the top opening of the canister 1151, whereas in the container 701 the outside diameter D5 of the gripping ring is greater than the inside diameter D2 of the top opening of the canister 751. The top opening of the canister 1151 is essentially the same as the canister main opening 707 of the canister 751 of FIG. 24.

More specifically, the canister 1151 of container 1101 includes a plurality of canister engagement features 1190, 1192 and 1194 which operate in essentially a similar manner as canister engagement features 790, 792 and 794 of container 701 of FIG. 24. The canister 1151 terminates at a canister upper lip 1116, and a cap securing feature 1128 is provided on the outside of the canister 1151 proximate (and below) the canister upper lip. The operator 1131 of container 1101 includes an operator main body portion 1133, which includes operator engagement feature 1182 (which can be similar to operator engagement feature 782 of FIG. 24). The operator 1131 further includes gripping ring 1126 which is located at the upper open end of the operator, and which surrounds (and thus defines) the operator main opening 1102 (and thus the container main opening). The lift 1110 includes one or more lift extensions 1181 (similar to lift extensions 781, FIG. 24) which engage the operator engagement feature(s) 1182 and the canister engagement feature(s) 790, 792, 794. As shown in the assembled drawing figure (FIG. 36) of the container 1101, a junction 1132 is formed where the gripping ring 1126 passes outward of the canister 1151. As described above with respect to container 701 and junction 732, this junction 1132 presents a location at which fluids can potentially flow into and out of the container 1101, and thus in certain uses it can be desirable to seal the junction 1132. For the container 1101, a cap 1152 can be used to cover (and thus seal) the operator main opening 1102 (which is also the container main opening), as well as sealing the junction 1132 by virtue of the cap 1152 engaging the cap securing feature 1128 (which is located below the junction 1132). As an alternative to the snap-on cap 1152 shown in FIG. 36, a screw-on cap (such as cap 752 of FIG. 25) can be used when the cap securing feature 1128 comprises one or more thread features (similar to thread features 728 of FIG. 25). In addition to cap 1152, other sealing means described above with respect to container 701, and variants thereof, can also be employed (such as sealing compounds, safety-seals, and shrink-wrap seals).

Gripping Ring Feature

It will be appreciated that the containers 701, 901, 1001 and 1101 (of respective FIGS. 25, 32, 35 and 36) all share a common feature in that for each container the gripping ring (726, 926, 1026 and 1126, respectively) of the operator (731, 931, 1031, 1131, respectively) extends above (i.e., extends beyond, or outward of) the canister upper lip (716, not shown for container 901, 1016 and 1116, respectively). The gripping ring can thus be described as a portion of the operator which extends above the canister upper lip. That is, the operators 731, 1031, 1131 of the containers 701, 1001, 1101 can be described as including a gripping ring portion 726, 1026, 1126 which extends above the canister upper lip 716, 1016, 1116. This feature (of the gripping ring portion of the operator extending above the upper lip of the canister) allows a user to more easily grasp the gripping ring portion (726, 1026, 1126) of the operator (731, 1031, 1131) in order to rotate the operator with respect to the canister (751, 1051, 1151). Moreover, this feature can be an improvement over other embodiments described herein which require a user to reach within the container in order to grasp the operator (e.g., for container 601 of FIGS. 22 and 23, a user must reach within the container in order to engage the top features 699 so that the user can rotate the operator 631 with respect to the canister 651). Furthermore, the outside diameter of the gripping ring (726, 926, 1026 and 1126) depicted in the embodiments of FIGS. 24-36 is not constrained to the diameters depicted. For example, the outside diameter of the gripping ring portion of the operator can be: (i) greater than the outside diameter of the canister about the canister upper lip; (ii) essentially the same as the outside diameter of the canister about the canister upper lip (per FIG. 25); (iii) essentially the same as the inside diameter of the canister about the canister upper lip (per FIG. 36); or (iv) less than the inside diameter of the canister about the canister upper lip.

It will further be appreciated that when the gripping ring portion of the operator (e.g., 726, 1026, 1126, as per FIGS. 25, 35 and 36, respectively) extends above the canister upper lip (716, 1016, 1116, respectively), then a junction (732, 1032, 1132, respectively) is created where the gripping ring portion of the operator (e.g., 731, 1031, 1131) passes above the canister upper lip. As described above, this junction presents a location at which fluids can ingress or ingress the interior of the container (701, 1001, 1101). And, as also described above, it can be desirable to seal this junction in addition to sealing the primary container opening (which corresponds to the operator opening 702, 1002, 1102). In order to seal both the junction and the primary container opening, a double-sealing means can be provided. One such double-sealing means can be a cap which includes a top portion which extends over the operator (container) main opening, and which further includes cap side walls which extend downward from the cap top portion to cover the junction, and wherein the cap sidewalls include engagement lugs configured to engage a cap securing feature which is formed on the exterior of the canister below the canister upper lip. Examples of such a double-sealing means cap have been specifically described above with respect to FIGS. 26 and 27.

An alternate double-sealing means can include a first sealing means which extends over the operator (container) main opening (e.g., 702, FIG. 25), but which does not extend downward to cover the junction (e.g., 732, FIG. 25). (As an example, the first sealing means can be a safety seal, such as safety seal 500 of FIG. 19, which can cover container main opening 702, FIG. 25. The first sealing means can also be a cap which engages a cap securing feature which is formed on the exterior of the gripping ring (not shown).) In this variation the double-sealing means can further include a second sealing means which seals the junction. (As an example, the second sealing means can be a shrink-wrap, such as shrink-wrap 753 of FIG. 27, which fits around the junction. The second sealing means can also be a sealing compound applied to the canister and/or the operator in the area of the junction (as described above).)

INTERPRETATION NOTES

The above description has set out various features, functions, methods and other aspects of the inventions. This has been done with regard to the currently disclosed embodiments thereof. Time and further development may change the manner in which the various aspects are implemented. Such aspects may further be added to by the language of the claims which are incorporated by reference hereinto as originally filed.

The scope of protection accorded the inventions as defined by the claims is not intended to be necessarily limited to the specific sizes, shapes, features or other aspects of the currently preferred embodiments depicted and described. The claimed invention(s) may be implemented or embodied in other forms while still being within the concepts depicted, described and claimed herein. Also included are equivalents of the invention(s) which can be made without departing from the scope of concepts properly protected hereby.

While the above disclosure has been described in language more or less specific as to structural and methodical features, it is to be understood, however, that the embodiments disclosed herein are not limited to the specific features shown and described, since the means herein disclosed comprise preferred forms of putting the embodiments into effect. Certain features described with respect to one embodiment can oftentimes be used with, or modified for use with, other embodiments. The embodiments are therefore claimed in any of their forms or modifications within the proper scope of the appended claims as appropriately interpreted.

I claim:

1. A container comprising:

a canister defining a canister interior cavity, the canister having at least one interior sidewall and a canister top opening defined by a canister upper lip and a canister opening diameter, and wherein the canister includes at least one engagement feature that comprises a groove formed in the canister interior sidewall that is either a substantially helical groove or a substantially longitudinal groove;

a lift having one or more lift projections extending therefrom, the lift structured to hold contents and be movable vertically with the container; and an operator comprising an operator main body portion which defines an operator interior cavity and an operator main body portion outside diameter, the operator having a gripping ring disposed at a first end of the operator and further structured to be gripped to rotate the operator within the canister to move the lift vertically, wherein the operator includes at least one operator engagement feature that comprises a slot formed though the operator main body portion, wherein the at least one operator feature comprises a substantially helical slot when the at least one canister engagement feature comprises a substantially longitudinal groove and wherein the at least one operator feature comprises a substantially longitudinal slot when the at least one canister engagement feature comprises a substantially helical groove;

wherein the lift is received in the operator interior cavity and the operator main body portion is received within the canister interior cavity such that each of the one or more lift projections extend through a respective operator engagement feature into a respective canister engagement feature to allow the lift to move vertically within the container;

wherein the canister inside diameter and the operator main body portion outside diameter are selected such that the operator main body portion when received within the canister interior cavity is close enough to the interior sidewall of the canister to enable each of the one or more lift projections to extend through the respective operator engagement feature into the respective canister engagement feature; and wherein rotation of the operator relative to the operator relative to the canister causes the one or more lift projections to travel along the respective canister engagement features and the respective operator engagement features to thereby move the lift in a vertical direction within the operator main body portion.

2. The container of claim 1 wherein the gripping ring extends above the canister upper lip thereby enabling grasping the gripping ring on the outside of the operator main body portion to cause rotation of the operator with the canister to move the lift vertically.

3. The container of claim 2, further comprising a sealing means for sealing a junction between a lower edge of the gripping ring and the canister upper lip.

4. The container of claim 3 wherein the sealing means is at least one of a screw cap, a snap-on cap, a snap-off cap, or a sealing compound.

5. The container of claim 4 wherein the sealing means is an elastomeric sealing compound allowing for re-sealing.

6. The container of claim 2, further comprising a safety seal for sealing the canister top opening, wherein the safety seal is at least one of a shrink-wrap safety seal, or a pull-off safety seal.

7. The container of claim 2 wherein the gripping ring is of a diameter larger than the canister opening diameter.

8. The container of claim 2 wherein the gripping ring is of a diameter smaller than the canister opening diameter.

9. The container of claim 1, further comprising a sealing means for sealing the canister top opening.

10. The container of claim 9 wherein the sealing means is at least one of a removable safety seal, a cap, or a sealing compound that seals the canister top opening to secure the contents in the container.

11. The container of claim 1 wherein the gripping ring is of no larger diameter than the outside diameter of the operator main body portion thereby enabling grasping the gripping ring within the operator interior cavity to cause rotation of the operator with the canister to move the lift vertically.

12. The container of claim 1 wherein the operator is rotated in one direction to raise the lift within the container and the operator is rotated in an opposite direction to lower the lift within the container.

13. The container of claim 1, further comprising a lift lock unit to prevent the lift from being lowered back into the operator once the lift has reached the canister top.

14. The container of claim 1, further comprising a contents retainer for restraining contents from exiting the canister top opening inadvertently, the contents retainer comprising a flat surface corresponding to the shaper of the canister, wherein the contents retainer is attached to the gripping ring.

15. The container of claim 1 wherein the lift has at least three projections, the canister includes at least three engagement features, and the operator includes at least three operator engagement features.

16. The container of claim 1 wherein the lift includes at least one drain opening comprising a plurality of perforations or openings or a grate structured to allow liquid to drain from the contents as the contents is lifted in the container.

17. The container of claim 1, further comprising a lift view window fabricated from a clear or transparent material to allow position of the lift to be viewed from outside the container.

18. The container of claim 1, further comprising:

a power-driven driver located in a space between a bottom of the canister and a bottom of the operator main body portion and secured to the canister, the driver having a pinion gear that engages a ring gear provided on the bottom of the operator main body portion when the driver is energized by a power source, thereby rotating the operator within the canister to move the lift in the vertical direction.

19. A container comprising:

a canister defining a canister interior cavity, the canister having at least one interior sidewall and a canister top opening defined by a canister upper lip and a canister opening diameter, and wherein the canister includes at least one engagement feature that comprises a groove formed in the canister interior sidewall that is either a substantially helical groove or a substantially longitudinal groove;

a lift having one or more lift projections extending therefrom, the lift structured to hold contents and be movable vertically with the container; and an operator comprising an operator main body portion comprising a plurality of interconnected lobes each defining a lobe interior cavity, each lobe being defined by an outermost edge and collectively defining an operator interior cavity and an operator main body portion outside diameter, the operator having a gripping ring disposed at a first end of the operator and further structured to be gripped to rotate the operator within the canister to move the lift vertically, wherein the operator includes at least one operator engagement feature that comprises a slot formed though the operator main body portion at an outermost edge of each lobe, the at least one operator engagement feature comprising substantially helical slot when the at least one canister engagement feature comprises a substantially longitudinal groove and that comprises a substantially longitudinal slot when the at least one canister engagement feature comprises a substantially helical groove;

wherein the lift is received in the operator interior cavity and the operator main body portion is received within the canister interior cavity such that each of the one or more lift projections extend through a respective operator engagement feature into a respective canister engagement feature;

wherein the canister inside diameter and the operator main body portion outside diameter are selected such that the operator main body portion when received within the canister interior cavity is close enough to the interior sidewall of the canister to enable each of the one or more lift projections to extend through the respective operator engagement feature into the respective canister engagement feature; and wherein rotation of the operator relative to the operator relative to the canister causes the one or more lift projections to travel along the respective canister engagement features and the respective operator engagement features to thereby move the lift in a vertical direction within the operator main body portion.

20. The container of claim 19 wherein the container is fabricated from molded plastic, glass, or metal.

* * * * *